US012208488B2

(12) United States Patent
Shinozaki

(10) Patent No.: US 12,208,488 B2
(45) Date of Patent: Jan. 28, 2025

(54) COUPLING MECHANISM WITH SPHERICAL BEARING, METHOD OF DETERMINING BEARING RADIUS OF SPHERICAL BEARING, AND SUBSTRATE POLISHING APPARATUS

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 1118 days.

(21) Appl. No.: 16/523,093

(22) Filed: Jul. 26, 2019

(65) Prior Publication Data

US 2020/0039030 A1 Feb. 6, 2020

(30) Foreign Application Priority Data

Jul. 31, 2018 (JP) ..... 2018-143393

(51) Int. Cl.
*B24B 53/12* (2006.01)
*B24B 37/30* (2012.01)
(Continued)

(52) U.S. Cl.
CPC ..... *B24B 53/12* (2013.01); *B24B 37/30* (2013.01); *B24B 41/047* (2013.01); *B24B 53/02* (2013.01); *B24D 7/16* (2013.01)

(58) Field of Classification Search
CPC ..... B24B 37/10; B24B 37/102; B24B 37/105; B24B 37/30; B24B 41/047; B24B 53/02; B24B 53/012; B24B 53/017; B24D 7/16
(Continued)

(56) References Cited

U.S. PATENT DOCUMENTS 5,738,574 A 4/1998 Tolles et al.
5,804,507 A 9/1998 Perlov et al.
(Continued)

FOREIGN PATENT DOCUMENTS

CN 1461251 A 12/2003
CN 101786262 A 7/2010
(Continued)

OTHER PUBLICATIONS

Singapore Patent Application No. 10201906617W; Written Opinion and Search Report; dated Jun. 6, 2022; 7 pages.

*Primary Examiner* — Brian D Keller
*Assistant Examiner* — Marcel T Dion
(74) *Attorney, Agent, or Firm* — BakerHostetler

(57) ABSTRACT

A coupling mechanism capable of preventing vibration of a rotating body from occurring due to a lower-bearing friction torque is disclosed. The coupling mechanism includes an upper spherical bearing and a lower spherical bearing disposed between a drive shaft and a rotating body. The upper spherical bearing has a first concave contact surface and a second convex contact surface, and the lower spherical bearing has a third concave contact surface and a fourth convex contact surface. The first concave contact surface, the second convex contact surface, the third concave contact surface, and the fourth convex contact surface are arranged concentrically. A lower-bearing radius of the lower spherical bearing is determined so that a lower-restoring torque is equal to or less than 0, the lower-restoring torque being the sum of a rotating-body friction torque generated in the rotating body due to a rotating-body frictional force between a polishing pad and the rotating body, and a lower-bearing friction torque generated in the rotating body due to a frictional force between the third concave contact surface and the fourth convex contact surface.

6 Claims, 14 Drawing Sheets

(51) Int. Cl.

| | |
|---|---|
| ***B24B 41/047*** | (2006.01) |
| ***B24B 53/02*** | (2012.01) |
| *B24D 7/16* | (2006.01) |

(58) Field of Classification Search
USPC ..... 451/259, 342, 443, 287, 288
See application file for complete search history.

(56) References Cited

U.S. PATENT DOCUMENTS

| | | | | |
|---|---|---|---|---|
| 5,899,798 | A * | 5/1999 | Trojan | B24B 37/30 451/259 |
| 6,036,583 | A * | 3/2000 | Perlov | B24B 53/017 451/288 |
| 6,116,990 | A | 9/2000 | Sinclair et al. | |
| 6,755,723 | B1 * | 6/2004 | Pham | B24B 37/30 451/287 |
| 7,137,874 | B1 | 11/2006 | Bovio et al. | |
| 2014/0065931 | A1 * | 3/2014 | Shinozaki | B24B 49/18 451/72 |
| 2015/0133038 | A1 | 5/2015 | Yamaki et al. | |
| 2016/0256976 | A1 | 9/2016 | Shinozaki | |

FOREIGN PATENT DOCUMENTS

| | | | |
|---|---|---|---|
| CN | 105856057 | A | 8/2016 |
| JP | H09-314456 | A | 12/1997 |
| JP | H11-151649 | A | 6/1999 |
| JP | 2001-150321 | A | 6/2001 |
| JP | 2009-034784 | A | 2/2009 |
| JP | 2011-124302 | A | 6/2011 |
| JP | 2016-144860 | A | 8/2016 |

* cited by examiner

COUPLING MECHANISM WITH SPHERICAL BEARING, METHOD OF DETERMINING BEARING RADIUS OF SPHERICAL BEARING, AND SUBSTRATE POLISHING APPARATUS

CROSS REFERENCE TO RELATED APPLICATION

This document claims priority to Japanese Patent Application Number 2018-143393 filed Jul. 31, 2018, the entire contents of which are hereby incorporated by reference.

BACKGROUND

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique of a surface of the semiconductor device is becoming more important. The most important technique in this planarization technique is chemical mechanical polishing. This chemical mechanical polishing (which will be hereinafter called CMP) is a process of polishing a substrate, such as a wafer, by placing the substrate in sliding contact with a polishing pad while supplying a polishing liquid containing abrasive grains, such as silica ($SiO_2$), onto the polishing pad.

This chemical mechanical polishing is performed using a CMP apparatus. The CMP apparatus typically includes a polishing table with a polishing pad attached to an upper surface thereof, and a polishing head for holding a substrate, such as a wafer. The polishing table and the polishing head are rotated about their own axes respectively, and in this state the polishing head presses the substrate against a polishing surface (i.e., an upper surface) of the polishing pad, while a polishing liquid is supplied onto the polishing surface, to thereby polish the surface of the substrate. The polishing liquid to be used is typically composed of an alkali solution and fine abrasive grains, such as silica, suspended in the alkali solution. The substrate is polished by a combination of a chemical polishing action by the alkali and a mechanical polishing action by the abrasive grains.

As polishing of the substrate is performed, the abrasive grains and polishing debris adhere to the polishing surface of the polishing pad. In addition, characteristics of the polishing pad change and its polishing performance is lowered. As a result, as polishing of the substrate is repeated, a polishing rate is lowered. Thus, in order to restore the polishing surface of the polishing pad, a dressing apparatus is provided adjacent to the polishing table.

The dressing apparatus typically includes a dresser having a dressing surface which is brought into contact with the polishing pad. The dressing surface is formed by abrasive grains, such as diamond particles. The dressing apparatus is configured to press the dressing surface against the polishing surface of the polishing pad on the rotating polishing table, while rotating the dresser about its own axis, to thereby remove the abrasive grains and the polishing debris deposited on the polishing surface, and to planarize and condition (or dress) the polishing surface.

Each of the polishing head and the dresser is a rotating body that is rotated about its own axis. When the polishing pad is rotated, undulation may occur on the surface (i.e., the polishing surface) of the polishing pad. Thus, in order to enable the rotating body to follow the undulation of the polishing surface, a coupling mechanism that couples the rotating body to a drive shaft through a spherical bearing, is used. Since the coupling mechanism allows the rotating body to be tiltably coupled to the drive shaft, the rotating body can follow the undulation of the polishing surface.

Japanese Laid-open Patent Publication No. 2016-144860 discloses a coupling mechanism (gimbal mechanism) for coupling a rotating body, such as a polishing head and a dresser, to a drive shaft, the coupling mechanism including an upper spherical bearing and a lower spherical bearing. The upper spherical bearing has a first concave contact surface, and a second convex contact surface which is in contact with the first concave contact surface. The lower spherical bearing has a third concave contact surface, and a fourth convex contact surface which is in contact with the third concave contact surface. The first concave contact surface and the second convex contact surface are located above the third concave contact surface and the fourth convex contact surface, and the first concave contact surface, the second convex contact surface, the third concave contact surface, and the fourth convex contact surface are arranged concentrically. Specifically, the upper spherical bearing and the lower spherical bearing of the coupling mechanism disclosed in Japanese Laid-open Patent Publication No. 2016-144860 have different bearing radii (i.e., different radii of rotation), while having the same rotational center.

According to the coupling mechanism disclosed in Japanese Laid-open Patent Publication No. 2016-144860, the upper spherical bearing and the lower spherical bearing can receive a force in a radial direction which is applied to the rotating body, and a force in an axial direction which may cause the rotating body to vibrate, while being able to exert a sliding force against a moment which is generated around the rotating center due to a frictional force generated between the rotating body and the polishing pad. As a result, flutter or vibration of the rotating body can be effectively prevented.

The force in the radial direction which is applied to the upper spherical bearing and the lower spherical bearing having the same rotational center CP is a frictional force that is generated between the rotating body and the polishing pad. For example, the force in the radial direction which is, during dressing, applied to the upper spherical bearing and the lower spherical bearing is a frictional force that is generated between the dresser and the polishing pad. In this specification, the frictional force generated between the rotating body and the polishing pad is referred to as "a rotating-body frictional force".

The present inventors investigated intensively a structure of the aforementioned coupling mechanism, and have found that the rotating-body frictional force causes a frictional force to be particularly generated between the third concave contact surface and the fourth convex contact surface. Further, it has been found that the rotating-body frictional force causes a frictional force to be generated between the first concave contact surface and the second convex contact surface depending on a magnitude of the rotating-body frictional force and a magnitude of a bearing radius of the lower spherical bearing. In this specification, the frictional force that is generated between the third concave contact surface and the fourth convex contact surface of the lower spherical bearing due to the rotating-body frictional force is referred to as "a lower-bearing frictional force". Similarly, the frictional force that is generated between the first concave contact surface and the second convex contact surface of the upper spherical bearing due to the rotating-body frictional force is referred to as "an upper-bearing frictional force".

Each of the lower-bearing frictional force and the upper-bearing frictional force causes a torque attempting to rotate the rotating body around the rotational center CP to be generated. In this specification, the torque generated in the rotating body due to the lower-bearing frictional force is referred to as "a lower-bearing friction torque", and the torque generated in the rotating body due to the upper-bearing frictional force is referred to as "an upper-bearing friction toque". As the lower-bearing friction torque and the upper-bearing friction toque are increased, a peripheral portion of the rotating body may be caught with the polishing pad, thereby causing vibration to occur in the rotating body. In particular, as a pressing force for pressing the rotating body against the polishing pad is increased, the lower-bearing friction torque and the upper-bearing friction toque are increased, so that possibility that the vibration occurs in the rotating body is increased.

SUMMARY OF THE INVENTION

According to an embodiment, there is provided a coupling mechanism capable of preventing vibration of a rotating body from occurring particularly due to a lower-bearing friction torque. Further, there is provided a method of determining a bearing radius of a spherical bearing provided in such a coupling mechanism. Further, there is provided a polishing apparatus in which such a coupling mechanism is incorporated.

Embodiments, which will be described below, relate to a coupling mechanism for coupling a rotating body to a drive shaft, and more particularly to a coupling mechanism for coupling a rotating body to a drive shaft through a spherical bearing. The below-described embodiments also relate to a method of determining a bearing radius of the spherical bearing installed in such a coupling mechanism, and a substrate polishing apparatus in which such a coupling mechanism is incorporated.

In an embodiment, there is provided a coupling mechanism for tiltably coupling a rotating body to be pressed against a polishing pad to a drive shaft, comprising: an upper spherical bearing and a lower spherical bearing disposed between the drive shaft and the rotating body, wherein the upper spherical bearing has a first concave contact surface and a second convex contact surface which is in contact with the first concave contact surface, the lower spherical bearing has a third concave contact surface and a fourth convex contact surface which is in contact with the third concave contact surface, the first concave contact surface and the second convex contact surface are located above the third concave contact surface and the fourth convex contact surface, the first concave contact surface, the second convex contact surface, the third concave contact surface, and the fourth convex contact surface are arranged concentrically, a lower-bearing radius of the lower spherical bearing is determined so that a lower-restoring torque is equal to or less than 0, and the lower-restoring torque is the sum of a rotating-body friction torque generated in the rotating body due to a rotating-body frictional force between the polishing pad and the rotating body, and a lower-bearing friction torque generated in the rotating body due to a frictional force between the third concave contact surface and the fourth convex contact surface.

The lower-restoring torque is a tilting torque that tilts the rotating body about the rotational center to thereby attempt to press the rotating body against the polishing pad. In this specification, a polar coordinate system with its origin located on the rotational center is set. In this polar coordinate system, it is defined that, when the polishing pad moves at a velocity (+V) from a right side to a left side, a tilting torque that attempts to rotate the rotating body in a clockwise direction takes positive numbers, and a tilting torque that attempts to rotate the rotating body in a counterclockwise direction takes negative numbers. In such a polar coordinate system, when the lower-restoring torque is equal to or less than 0, the rotating body attempts to tilt in a moving direction of the polishing pad, while the polishing pad travels away from the peripheral portion (i.e., edge portion) of the rotating body. Accordingly, a state in which the peripheral portion of the rotating body sinks into the polishing pad is not induced, so that an attitude of the rotating body becomes stable. In contrast, when the lower-restoring torque is larger than 0, the rotating body attempts to tilt in a direction opposite to the moving direction of the polishing pad. Accordingly, the peripheral portion of the rotating body tends to sink into the polishing pad, so that the attitude of the rotating body becomes unstable.

If it is defined in the polar coordinate system that, when the polishing pad moves at a velocity (+V) from a right side to a left side, the tilting torque that attempts to rotate the rotating body in a clockwise direction takes negative numbers, and the tilting torque that attempts to rotate the rotating body in a counterclockwise direction takes negative numbers, the aforementioned condition "the lower-restoring torque is equal to or less than 0" is replaced with a condition "the lower-restoring torque is equal to or more than 0".

In an embodiment, an upper-bearing radius of the upper spherical bearing is determined so that an upper-restoring torque is equal to or less than 0, and the upper-restoring torque is the sum of the rotating-body friction torque and an upper-bearing friction torque generated in the rotating body due to a frictional force between the first concave contact surface and the second convex contact surface.

In an embodiment, there is provided a method of determining a bearing radius of a coupling mechanism including an upper spherical bearing having a first concave contact surface and a second convex contact surface which is in contact with the first concave contact surface, and a lower spherical bearing having a third concave contact surface and a fourth convex contact surface which is in contact with the third concave contact surface, the upper spherical bearing and the lower spherical bearing having a same rotational center, comprising: determining a lower-bearing radius of the lower spherical bearing so that the a lower-restoring torque is equal to or less than 0, wherein the lower-restoring torque is the sum of a rotating-body friction torque generated in the rotating body due to a rotating-body frictional force between the polishing pad and the rotating body, and a lower-bearing friction torque generated in the rotating body due to a frictional force between the third concave contact surface and the fourth convex contact surface.

In an embodiment, an upper-bearing radius of the upper spherical bearing is determined so that an upper-restoring torque is equal to or less than 0, and the upper-restoring torque is the sum of the rotating-body friction torque and an upper-bearing friction torque generated in the rotating body due to a frictional force between the first concave contact surface and the second convex contact surface.

In an embodiment, there is provided a substrate polishing apparatus comprising; a polishing table for supporting a polishing pad; and a polishing head configured to press a substrate against the polishing pad, wherein the polishing head is coupled to a drive shaft through the above-described coupling mechanism.

In an embodiment, there is provided a substrate polishing apparatus comprising: a polishing table for supporting a polishing pad; a polishing head configured to press a substrate against the polishing pad; and a dresser which is pressed against the polishing pad, wherein the dresser is coupled to a drive shaft through the above-described coupling mechanism.

According to the above-described embodiments, the radius of the lower spherical bearing is determined so that the lower-bearing friction torque generated in the rotating body due to the lower-bearing frictional force is cancelled by the rotating-body friction torque generated in the rotating body due to the rotating-body frictional force. As a result, occurrence of the vibration of the rotating body can be effectively prevented, because turning of the rotating body, caused by the lower-bearing friction torque, around the rotational center can be prevented.

DESCRIPTION OF THE EMBODIMENTS

Embodiments will be described below with reference to the drawings.

Figure 1:
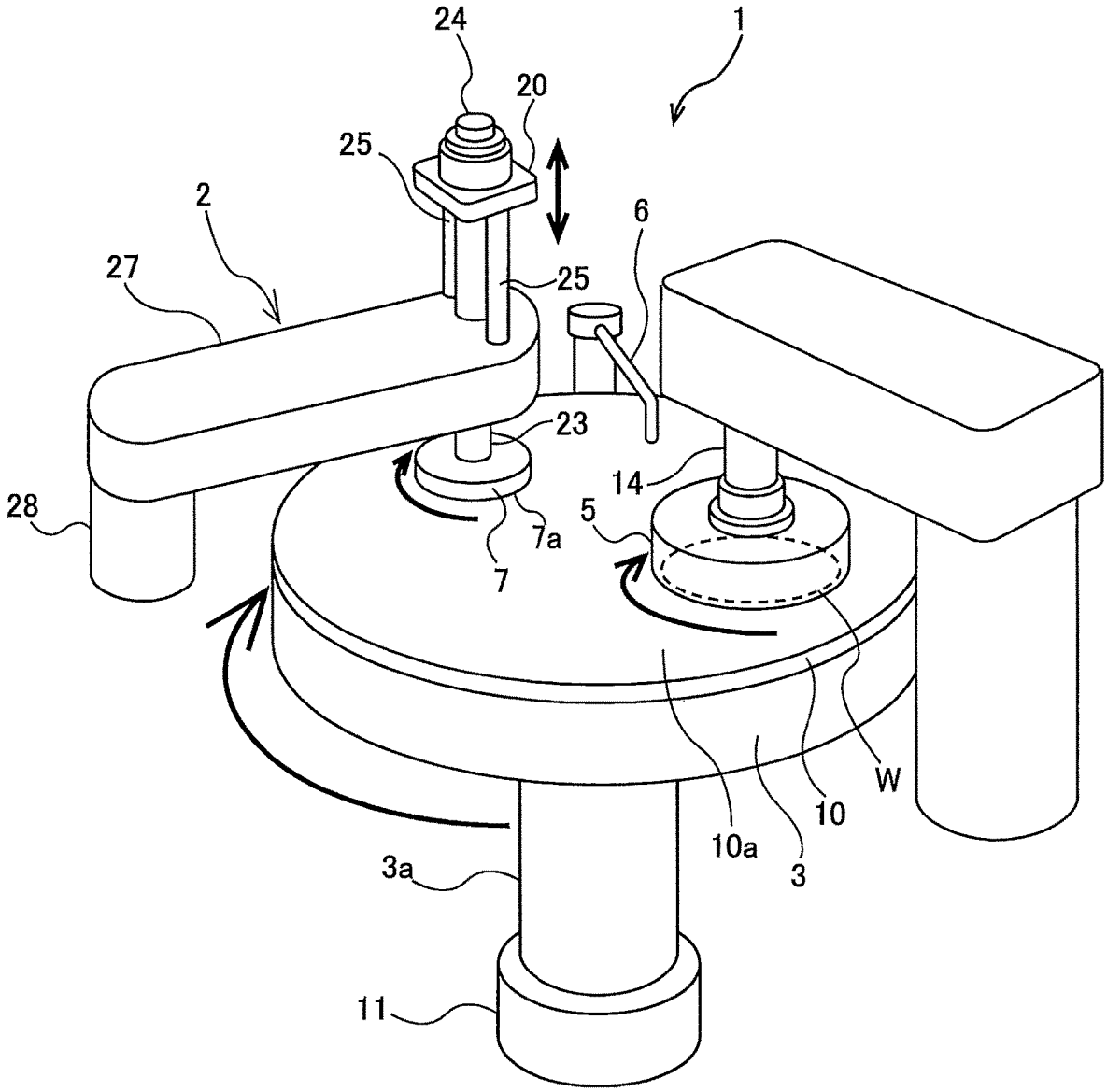
FIG. 1 is a perspective view schematically showing a substrate polishing apparatus according to an embodiment.

FIG. 1 is a perspective view schematically showing a substrate polishing apparatus 1 according to an embodiment. This substrate polishing apparatus 1 includes a polishing table 3 to which a polishing pad 10, having a polishing surface 10*a*, is attached, a polishing head 5 for holding a substrate W, such as a wafer, and pressing the substrate W against the polishing pad 10 on the polishing table 3, a polishing liquid supply nozzle 6 for supplying a polishing liquid and a dressing liquid (e.g., pure water) onto the polishing pad 10, and a dressing apparatus 2 having a dresser 7 for dressing the polishing surface 10*a* of the polishing pad 10.

The polishing table 3 is coupled to a table motor 11 through a table shaft 3*a*, so that the polishing table 3 is rotated by this table motor 11 in a direction indicated by arrow. The table motor 11 is located below the polishing table 3. The polishing pad 10 is attached to an upper surface of the polishing table 3. The polishing pad 10 has an upper surface, which provides the polishing surface 10*a* for polishing the wafer. The polishing head 5 is coupled to a lower end of a head shaft 14. The polishing head 5 is configured to be able to hold the wafer on its lower surface by vacuum suction. The head shaft 14 is elevated and lowered by an elevating mechanism (not shown).

Polishing of the wafer W is performed as follows. The polishing head 5 and the polishing table 3 are rotated in directions as indicated by arrows, respectively, and the polishing liquid (or slurry) is supplied onto the polishing pad 10 from the polishing liquid supply nozzle 6. In this state, the polishing head 5 presses the wafer W against the polishing surface 10*a* of the polishing pad 10. The surface of the wafer W is polished by a mechanical action of abrasive grains contained in the polishing liquid and a chemical action of the polishing liquid. After polishing of the wafer W, dressing (or conditioning) of the polishing surface 10*a* is performed by the dresser 7.

The dressing apparatus 2 includes the dresser 7 which is brought into sliding contact with the polishing pad 10, a dresser shaft 23 to which the dresser 7 is coupled, a pneumatic cylinder 24 mounted to an upper end of the dresser shaft 23, and a dresser arm 27 for rotatably supporting the dresser shaft 23. A lower surface of the dresser 7 serves as a dressing surface 7*a*, and this dressing surface 7*a* is formed by abrasive grains (e.g., diamond particles). The pneumatic cylinder 24 is disposed on a support base 20 which is supported by a plurality of columns 25, which are fixed to the dresser arm 27.

The dresser arm 27 is actuated by a motor (not shown) to pivot on a pivot shaft 28. The dresser shaft 23 is rotated about its own axis by an actuation of a motor (not shown), thus rotating the dresser 7 about the dresser shaft 23 in a direction indicated by arrow. The pneumatic cylinder 24 serves as an actuator for moving the dresser 7 vertically through the dresser shaft 23 and for pressing the dresser 7 against the polishing surface (front surface) 10*a* of the polishing pad 10 at a predetermined pressing force.

Dressing of the polishing pad 10 is performed as follows. The pure water is supplied from the polishing liquid supplying nozzle 6 onto the polishing pad 10, while the dresser 7 is rotated about the dresser shaft 23. In this state, the dresser 7 is pressed against the polishing pad 10 by the pneumatic cylinder 24 to place the dressing surface 7*a* in sliding contact with the polishing surface 10*a* of the polishing pad 10. Further, the dresser arm 27 pivots around the pivot shaft 28 to cause the dresser 7 to oscillate in a radial direction of the polishing pad 10. In this manner, the dresser 7 scrapes the polishing pad 10 to thereby dress (or restore) the surface 10*a* of the polishing pad 10.

The aforementioned head shaft 14 is a drive shaft which is rotatable and vertically movable, and the aforementioned polishing head 5 is a rotating body which rotates about its own axis. Similarly, the aforementioned dresser shaft 23 is a drive shaft which is rotatable and vertically movable, and the aforementioned dresser 7 is a rotating body which rotates about its own axis. These rotating bodies 5, 7 are coupled to the drive shafts 14, 23 through coupling mechanisms, respectively, which will be described below, so as to be tiltable with respect to the drive shafts 14, 23.

Figure 2:
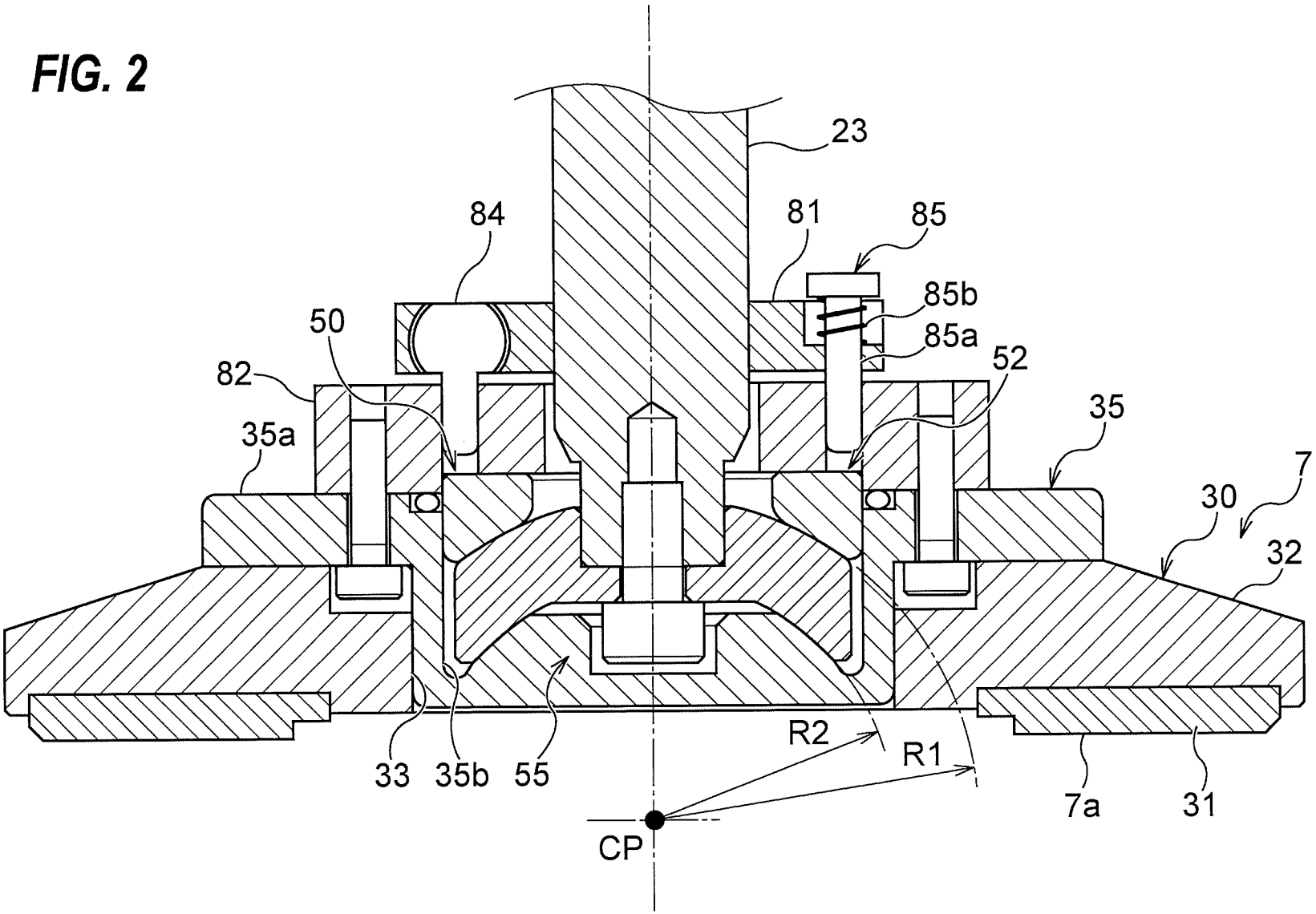
FIG. 2 is a schematic cross-sectional view showing a dresser which is supported by a coupling mechanism according to an embodiment.

FIG. 2 is a schematic cross-sectional view showing the dresser (rotating body) 7 which is supported by the coupling mechanism according to an embodiment. As shown in FIG. 2, the dresser 7 of the dressing apparatus 2 includes a circular disk holder 30, and an annular dresser disk 31 which is fixed to a lower surface of the disk holder 30. The disk holder 30 is composed of a holder body 32 and a sleeve 35. A lower surface of the dresser disk 31 serves as the aforementioned dressing surface 7*a*.

A hole 33 is formed in the holder body 32 of the disk holder 30, and a central axis of this hole 33 is aligned with a central axis of the dresser 7 which is rotated by the dresser shaft (drive shaft) 23. The hole 33 extends in a vertical direction through the holder body 32.

The sleeve 35 is fitted into the hole 33 of the holder body 32. A sleeve flange 35*a* is formed at an upper portion of the sleeve 35, and this sleeve flange 35*a* has a lower surface which is in contact with an upper surface of the holder body 32. In this state, the sleeve 35 is fixedly mounted to the holder body 32 by a fixing member (not shown), such as a screw. The sleeve 35 has an insertion recess 35*b* which opens upwardly. An upper spherical bearing 52 and a lower spherical bearing 55 of a coupling mechanism (gimbal mechanism) 50, which will be described later, are disposed in the insertion recess 35*b*.

As shown in FIG. 2, an annular upper flange 81, an annular lower flange 82, a plurality of torque transmission pins 84, and a plurality of spring mechanisms 85 are provided for tiltalby coupling the dresser 7 to the dresser shaft 23. In this embodiment, the upper flange 81 has a diameter which is smaller than a diameter of the lower flange 82. The upper flange 81 is fixed to the dresser shaft 23. A small clearance is formed between the upper flange 81 and the lower flange 82. The upper flange 81 and the lower flange 82 may be made of metal, such as stainless steel.

The lower flange 82 is secured to the upper surface of the sleeve 35 of the dresser 7, and is coupled to the dresser 7. Further, the upper flange 81 and the lower flange 82 are coupled to each other through the plurality of torque transmission pins (torque transmission members) 84. These torque transmission pins 84 are arranged around the upper flange 81 and the lower flange 82 (i.e., around the central axis of the dresser shaft 23) at equal intervals. The torque transmission pins 84 transmit the torque of the dresser shaft 23 to the dresser 7, while permitting the tiling movement of the dresser 7 with respect to the dresser shaft 23.

Each torque transmission pin 84 has a spherical sliding surface. This sliding surface loosely engages with a receiving hole formed in the upper flange 81. A slight clearance is formed between the sliding surface of the torque transmission pin 84 and the receiving hole of the upper flange 81. When the lower flange 82 and the dresser 7, coupled to the lower flange 82, tilt with respect to the upper flange 81 through the upper spherical bearing 52 and the lower spherical bearing 55, which will be described latter, the torque transmission pins 84 also tilt together with the lower flange 82 and the dresser 7, while maintaining the engagement with the upper flange 81.

The torque transmission pins 84 transmit the torque of the dresser shaft 23 to the lower flange 82 and the dresser 7. With the above-described configurations, the dresser 7 and the lower flange 82 are tiltable around a rotational center CP of the upper spherical bearing 52 and the lower spherical bearing 55, and the torque of the dresser shaft 23 can be transmitted to the dresser 7 through the torque transmission pins 84 without restricting the tilting motion.

Further, the upper flange 81 and the lower flange 82 are coupled to each other by the plurality of spring mechanisms 85. These spring mechanisms 85 are arranged around the upper flange 81 and the lower flange 82 (i.e., around the central axis of the dresser shaft 23) at equal intervals. Each spring mechanism 85 has a rod 85*a* which is secured to the lower flange 82 and extends through the upper flange 81, and a spring 85*b* which is disposed between an upper surface of the upper flange 81 and a flange portion formed at an upper end of the rod 85*a*. The spring mechanisms 85 generate a force against the tilting motions of the dresser 7 and the lower flange 82 to recover the dresser 7 to its original position (attitude).

In the embodiment shown in FIG. 2, the tilting stiffness, when the dresser 7 and the lower flange 82 tilts around the rotational center CP, can be changed depending on a spring constant of the spring 85*b*, because the torque transmission pins 84 transmit the torque of the dresser shaft 23 to the dresser 7. Therefore, the tilting stiffness around the rotational center CP can be set arbitrarily, and as a result, the tilting stiffness around the rotational center CP can be lowered.

In order to enable the dresser 7 to follow an undulation of the polishing surface 10*a* of the rotating polishing pad 10, the disk holder 30 of the dresser (rotating body) 7 is coupled to the dresser shaft (drive shaft) 23 through the coupling mechanism (gimbal mechanism) 50. The coupling mechanism 50 will be described below.

Figure 3:
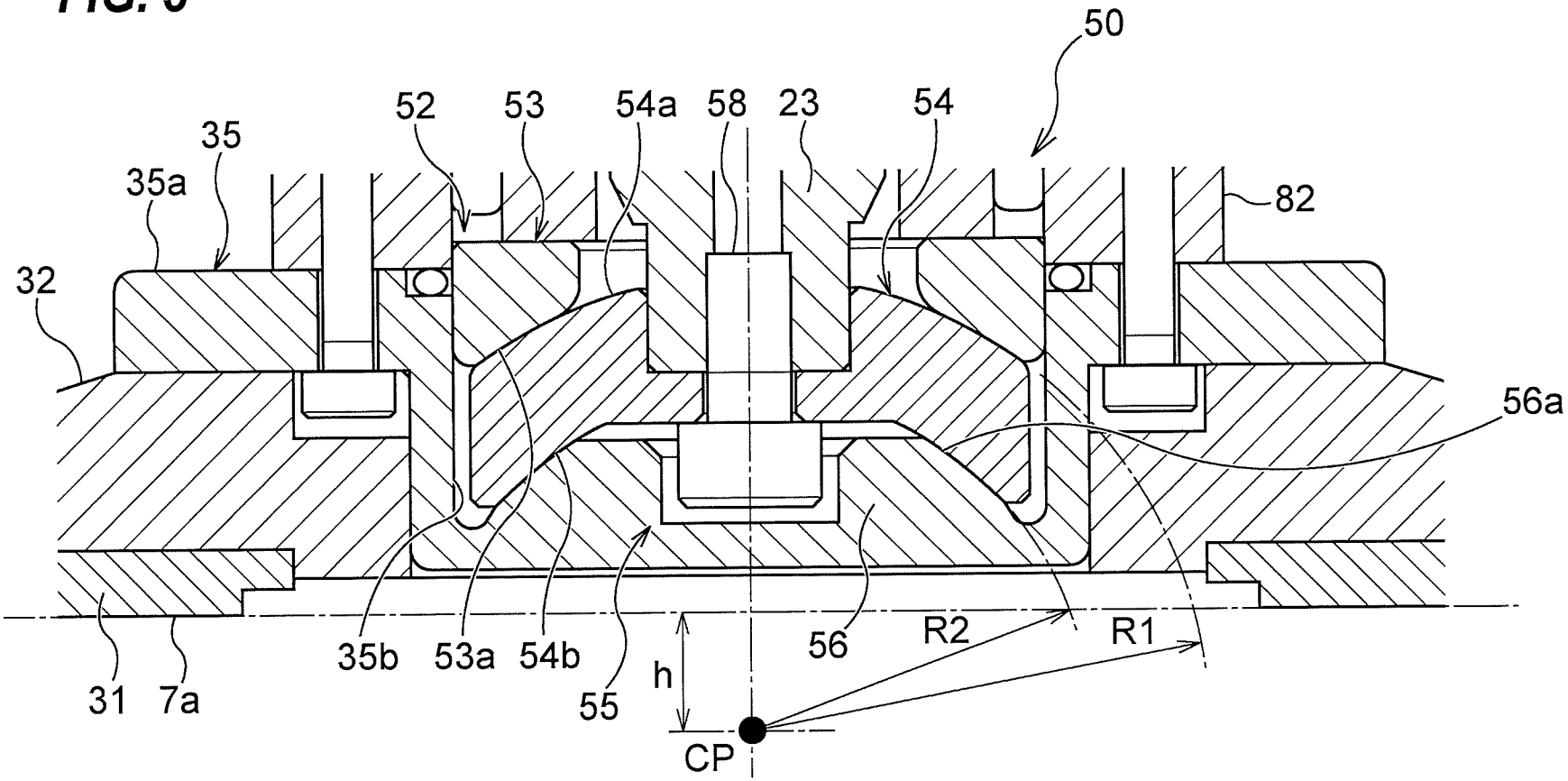
FIG. 3 is an enlarged view of the coupling mechanism shown in FIG. 2.

FIG. 3 is an enlarged view of the coupling mechanism 50 shown in FIG. 2. The coupling mechanism 50 includes the upper spherical bearing 52 and the lower spherical bearing 55 which are separated from each other in a vertical direction. The upper spherical bearing 52 has a first concave contact surface, and a second convex contact surface which is in contact with the first concave contact surface. The lower spherical bearing 55 has a third concave contact surface, and a fourth convex contact surface which is in contact with the third concave contact surface. These upper spherical bearing 52 and lower spherical bearing 55 are disposed between the dresser shaft 23 and the dresser 7.

In the coupling mechanism shown in FIG. 3, the upper spherical bearing 52 is composed of an annular first sliding-contact member 53 having the first concave contact surface, and a second sliding-contact member 54 having the second convex contact surface. In this embodiment, a lower surface 53*a* of the first sliding-contact member 53 serves as the first concave contact surface, and an upper surface 54*a* of the second sliding-contact member 54 serves as the second convex contact surface. Hereinafter, the lower surface 53*a* of the first sliding-contact member 53 will occasionally be referred to as "the first concave contact surface 53*a*", and the upper surface 54*a* of the second sliding-contact member 54 will occasionally be referred to as "the second convex contact surface 54*a*".

Each of the first concave contact surface 53*a* of the first sliding-contact member 53 and the second convex contact surface 54*a* of the second sliding-contact member 54 has a shape of a part of an upper half of a spherical surface having a first radius of rotation R1. Accordingly, these two first concave contact surface 53*a* and second convex contact surface 54*a* have the same radius of curvature (which is equal to the aforementioned first radius of rotation R1), and slidably engage with one another. In this specification, the first radius of rotation R1 will be occasionally referred to as "an upper-bearing radius R1".

Further, in the coupling mechanism 50 shown in FIG. 3, the lower spherical bearing 55 is composed of the second sliding-contact member 54 having the third concave contact surface, and a third sliding-contact member 56 having the fourth convex contact surface. In this embodiment, a lower surface 54*b* of the second sliding-contact member 54 serves as the third concave contact surface, and an upper surface 56*a* of the third sliding-contact surface 56 serves as the fourth convex contact surface. Hereinafter, the lower surface 54*b* of the second sliding-contact member 54 will be occasionally referred to as "the third concave contact surface 54*b*", and the upper surface 56*a* of the third sliding-contact member 56 will be occasionally referred to as "the fourth convex contact surface 56*a*".

Each of the third concave contact surface 54*b* of the second sliding-contact member 54 and the fourth convex contact surface 56*a* of the third sliding-contact member 56 has a shape of a part of an upper half of a spherical surface having a second radius of rotation R2 which is smaller than the aforementioned first radius of rotation R1. Thus, these two third concave contact surface 54*b* and fourth convex contact surface 56*a* have the same radius of curvature (which is equal to the aforementioned second radius of rotation R2), and slidably engage with one another. In this specification, the second radius of rotation R2 will be occasionally referred to as "a lower-bearing radius R2". The pressing force generated by the pneumatic cylinder 24 (see FIG. 1) is transmitted to the dresser 7 through the dresser shaft 23 and the lower spherical bearing 55.

In this embodiment, the second convex contact surface of the upper spherical bearing 52 and the third concave contact surface of the lower spherical bearing 55 is formed by the upper surface 54*a* and lower surface 54*b* of the second sliding-contact member 54, respectively. Specifically, the second sliding-contact member 54 is a component of the upper spherical bearing 52, while being also a component of the lower spherical bearing 55. Although not shown, the second sliding-contact member 54 may be divided into two portions in a vertical direction. In this case, an upper portion of the second sliding-contact member 54 serves as a part of the upper spherical bearing 52 having the second convex contact surface 54*a*, and a lower portion of the second sliding-contact member 54 serves as a part of the lower spherical bearing 55 having the third concave contact surface 54*b*.

Further, in this embodiment, the third sliding-contact member 56 is provided on a bottom surface of the sleeve 35 of the dresser 7, and the third sliding-contact member 56 is integral with the sleeve 35. In an embodiment, the third sliding-contact member 56 may be constituted as another member that is different from the sleeve 35.

The second sliding-contact member 54 is fixed to the dresser shaft 23. More specifically, a lower end of the dresser shaft 23 is inserted into the second sliding-contact member 54, and further the second sliding-contact member 54 is fitted to the lower end of the dresser shaft 23 by a fixing member 58. The first sliding-contact member 53 is inserted into the insertion recess 35*b* of the sleeve 35, and is further sandwiched between the annular lower flange 82 and the second sliding-contact member 54. When the second sliding-contact member 54 is fixed to the dresser shaft 23 the fixing member 58, the first sliding-contact member 53 is pressed against the lower flange 82.

Further, the sleeve 35 is fixed to the holder body 32 by fixing members (not shown), such as screws, so that the fourth convex contact surface 56*a* of the third sliding-contact member 56 is pressed against the third concave contact surface 54*b* of the second sliding-contact member 54. In this manner, the upper spherical bearing 52 and the lower spherical bearing 55 are formed. The upper spherical bearing 52 and the lower spherical bearing 55 are disposed in the insertion recess 35*b* of the sleeve 35 which is inserted and fitted into the hole 33 formed in the holder body 32. Wear particles, which are produced from the upper spherical bearing 52 and the lower spherical bearing 55, are received by the sleeve 35. Therefore, the sleeve 35 can prevent the wear particles from falling down onto the polishing pad 10.

The upper spherical bearing 52 and the lower spherical bearing 55 have different bearing radii (i.e., radii of rotation), while having the same rotational center CP. More specifically, the first concave contact surface 53*a*, the second convex contact surface 54*a*, the third concave contact surface 54*b*, and the fourth convex contact surface 56*a* are concentric, and their centers of curvature coincide with the rotational center CP. This rotational center CP is located below the first concave contact surface 53*a*, the second convex contact surface 54*a*, the third concave contact surface 54*b*, and the fourth convex contact surface 56*a*. By appropriately selecting the radii of curvature of the first concave contact surface 53*a*, the second convex contact surface 54*a*, the third concave contact surface 54*b*, and the fourth convex contact surface 56*a* which have the same rotational center CP, a distance h from a bottom end surface of the dresser 7 to the rotational center CP can be changed. More specifically, by appropriately selecting the upper-bearing radius R1 of the upper spherical bearing 52 and the lower-bearing radius R2 of the lower spherical bearing 55, the distance h from the bottom end surface of the dresser 7 to the rotational center CP can be changed. In this specification, the distance h from the bottom end surface of the dresser 7 to the rotational center CP is referred to as "a gimbal-axis height h". The gimbal-axis height h takes positive numbers when the rotational center CP is located below the bottom end surface of the dresser 7, and takes negative numbers when the rotational center CP is located above the bottom end surface of the dresser 7. In a case where the rotational center CP is located on the bottom end surface of the dresser 7, the gimbal-axis height h is 0.

The first concave contact surface 53*a* and the second convex contact surface 54*a* of the upper spherical bearing 52 is located above the third concave contact surface 54*b* and the fourth convex contact surface 56*a* of the lower spherical bearing 55. The dresser 7 is tiltably coupled to the dresser shaft 23 through the two spherical bearings, i.e., the upper spherical bearing 52 and the lower spherical bearing 55. Since the upper spherical bearing 52 and the lower spherical bearing 55 have the same rotational center CP, the dresser 7 can flexibly tilt in response to the undulation of the polishing surface 10*a* of the rotating polishing pad 10.

When the dresser 7 is elevated, the dresser 7 is supported by the upper spherical bearing 52. As a result, a dressing load on the polishing surface 10*a* can be finely controlled in a load range which is smaller than the gravity of dresser 7. Therefore, a fine dressing control can be performed.

The upper spherical bearing 52 and the lower spherical bearing 55 can receive a force in a radial direction which is applied to the dresser 7, while the spherical bearings 52, 55 can continuously receive a force in an axial direction (i.e., in a direction perpendicular to the radial direction) which is applied to the dresser 7. As described above, the pressing force (i.e., the force in the axial direction) generated by the pneumatic cylinder 24 (see FIG. 1) is transmitted to the dresser 7 through the dresser shaft 23 and the lower spherical bearing 55. Hereinafter, the force in the radial direction which is applied to the dresser (rotating body) 7, a rotating-body friction torque generated in the rotating body due to a frictional force between the dresser and the polishing pad, a frictional force generated in the lower spherical bearing 55 by the force in the radial direction, and a lower-bearing friction torque generated in the rotating body due to the frictional force generated in the lower spherical bearing 55 will be described.

Figure 4:
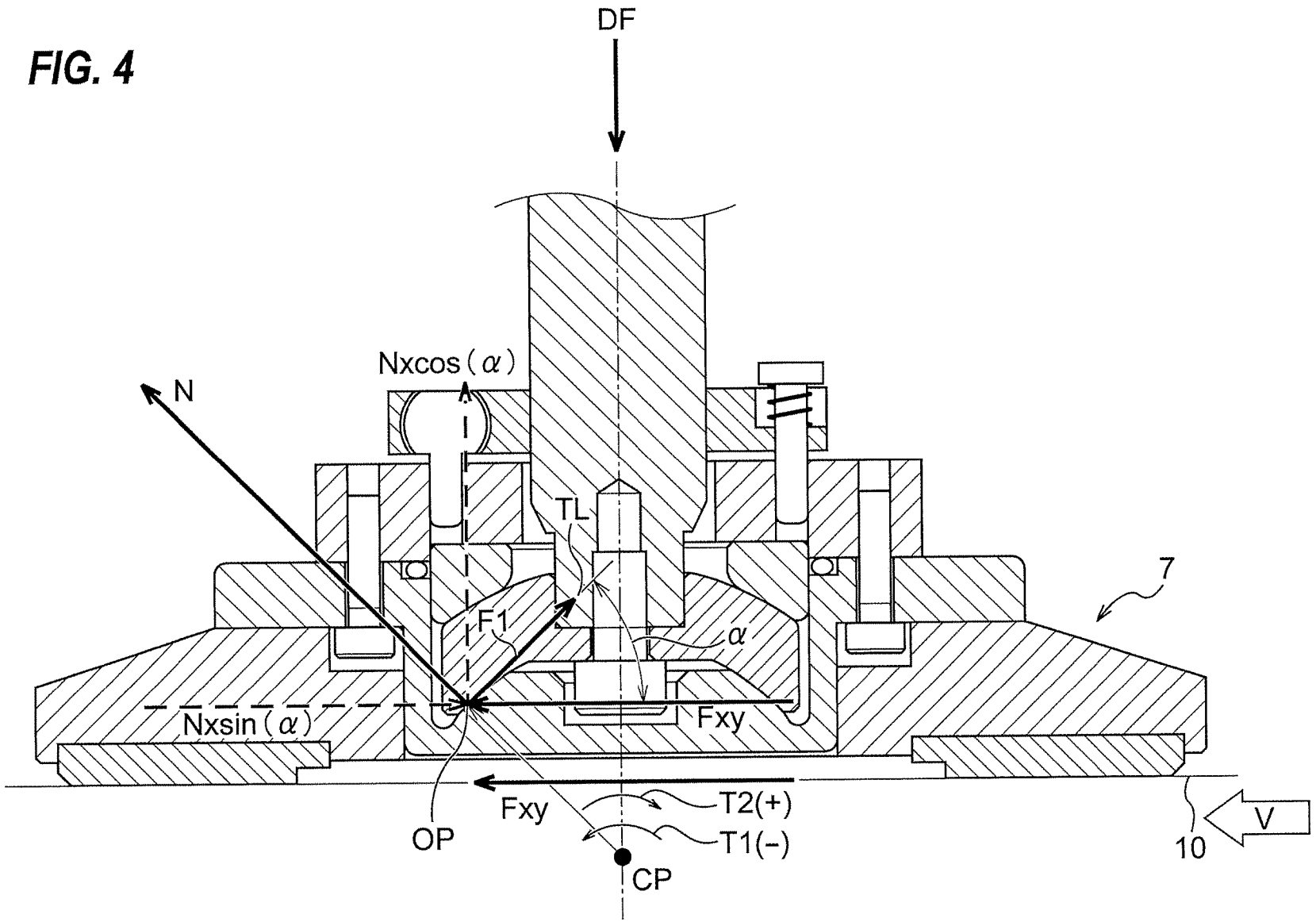
FIG. 4 is a schematic view illustrating a force in a radial direction which is applied to the dresser, a rotating-body friction torque, a frictional force generated in a lower spherical bearing, and a lower-bearing friction torque.

FIG. 4 is a schematic view illustrating the force in the radial direction which is applied to the dresser (rotating body) 7, the rotating-body friction torque, the frictional force generated in the lower spherical bearing 55, and the lower-bearing friction torque. In FIG. 4, a movement direction (rotation direction) of the polishing pad 10 relative to the dresser 7 is illustrated by arrow V. Further, as shown in FIG. 4, the dresser 7 is pressed against the polishing pad 10 at a predetermined pressing force DF.

As shown in FIG. 4, when the dresser 7 is pressed against the polishing pad 10 at the predetermined pressing force DF by the pneumatic cylinder 24 (see FIG. 1), a rotating-body frictional force Fxy, which is a force in the radial direction, is generated between the dresser 7 and the polishing pad 10. This rotating-body frictional force Fxy is obtained by multiplying the pressing force DF by a coefficient of friction COF1 between the dresser 7 and the polishing pad 10 (i.e., Fxy=DF·COF1). The coefficient of friction COF1 may be estimated based on experiences of designer of the coupling mechanism 50, or may be obtained from experiments and the like. In an embodiment, a measuring device capable of measuring the coefficient of friction COF1 may be made, and the coefficient of friction COF1 may be practically measured by using this measuring device.

In this embodiment, since the rotational center CP is located below the lower end surface of the dresser 7, the rotating-body frictional force Fxy causes a rotating-body friction torque T1, which attempts to rotate the dresser 7 in the moving direction of the polishing pad 10 and around the rotational center CP, to be generated. The rotating-body friction torque T1 is obtained by multiplying the rotating-body frictional force Fxy by the gimbal-axis height h (see FIG. 3) (i.e., T1=Fxy·h).

Further, since the pressing force DF is transmitted to the dresser 7 through the dresser shaft 23 and the lower spherical bearing 55, the rotating-body frictional force Fxy is applied to the lower spherical bearing 55. The present inventors have found by intensive studies that the rotating-body frictional force Fxy is mainly applied to an outer end (or near an outer end) of the lower spherical bearing 55. In view of this, in this embodiment, a point of application OP at which the rotating-body frictional force Fxy is applied to the lower spherical bearing 55 is set near the outer end of the lower spherical bearing 55.

As shown in FIG. 4, on the point of application OP, the fourth convex contact surface 56*a* is pressed against the third concave contact surface 54*b* at the rotating-body friction force Fxy in a horizontal direction, so that a reaction force N·sin(α), which is proportion to the rotating-body friction force Fxy, is generated on the third concave contact surface 54*b*. The symbol "α" represents an angle formed between a tangential line TL to the third concave contact surface 54*b* at the point of application OP, and the rotating-body friction force Fxy. Hereinafter, the angle α will be referred to as "a contact angle α". In the coupling mechanism 50 shown in FIG. 4, the contact angle α is 45 degrees.

As shown in FIG. 4, a lower-bearing surface force N is a force capable of being decomposed into the reaction force N·sin(α), and N·cos(α) that is a force component perpendicular to the reaction force N·sin(α). In other words, the lower-bearing surface force N has the reaction force N·sin(α) as a force component in the horizontal direction, and has the N·cos(α) as a force component in the vertical direction.

The lower-bearing surface force N generated in the lower spherical bearing 55 causes a lower-bearing frictional force F1 to be generated between the third concave contact surface 54*b* and the fourth convex contact surface 56*a*. As a result, in the dresser 7, a lower-bearing friction torque T2 due to the lower-bearing frictional force F1 is generated. The lower-bearing frictional force F1 is a force applied in the tangential direction TL at the point of application OP, and a magnitude of the lower-bearing frictional force F1 is obtained by multiplying the lower-bearing surface force N by a coefficient of friction COF2 between the third concave contact surface 54*b* and the fourth convex contact surface 56*b* (i.e., F1=N·COF2). This coefficient of friction COF2 may be estimated based on experiences of designer of the coupling mechanism 50, or may be obtained from experiments and the like. In an embodiment, a measuring device capable of measuring the coefficient of friction COF2 may be made, and the coefficient of friction COF2 may be practically measured by using this measuring device.

The lower-bearing frictional force F1 causes a lower-bearing friction torque T2, which attempts to rotate the dresser 7 around the rotational center CP and in a direction opposite to the rotating-body friction torque T1, to be generated. The lower-bearing friction torque T2 is obtained by multiplying the lower-bearing frictional force F1 by the lower-bearing radius R2 (i.e., T2=F1·R2).

In this specification, the polar coordinate system with its origin located on the rotational center CP is set. In this polar coordinate system, it is defined that, when the polishing pad 10 moves at a velocity (+V) from a right side to a left side relative to the dresser 7 (see FIG. 4), the lower-bearing friction torque T2 that attempts to rotate the dresser 7 in a clockwise direction takes positive numbers, and the rotating-body friction torque T1 that attempts to rotate the dresser 7 in a counterclockwise direction takes negative numbers.

As described above, in a case where the rotational center CP is located below the lower end surface of the dresser 7, the dresser 7 attempts to rotate toward the polishing pad 10 due to the rotating-body friction torque T1. When the dresser 7 is pressed against the polishing pad 10 at the pressing force DF, the rotating-body frictional force Fxy is necessarily generated, and thus, the rotating-body friction torque T1 is a torque that is necessarily generated during the dressing process. Further, the magnitude of the rotating-body friction torque T1 is changed depending on a magnitude of the pressing force DF, and a magnitude of the gimbal-axis height h. On the other hand, the lower-bearing friction torque T2 is a torque that is generated due to the rotating-body frictional force Fxy, and a magnitude of the lower-bearing friction torque T2 is changed depending on a magnitude of the rotating-body frictional force Fxy and a magnitude of the lower-bearing radius R2. The present inventors investigated intensively the coupling mechanism 50, and have found that, depending on the magnitude of the lower-bearing friction torque T2, the peripheral portion of the dresser 7 may be caught with the polishing pad 10 during the dressing process to thereby generate vibration in the dresser 7. If the vibration occurs in the dresser 7 during the dressing process, the polishing surface 10*a* of the polishing pad 10 cannot be appropriate dressed.

As described with reference to FIG. 4, the lower-bearing friction torque T2 is applied to the dresser 7 in the direction opposite to the rotating-body friction torque T1. In view of this, in this embodiment, the lower-bearing friction torque T2 is cancelled by the rotating-body friction torque T1 to thereby prevent the vibration from occurring in the dresser (rotating body) 7. The present inventors have been found that a stability condition expression for preventing the vibration of the dresser 7 caused by the lower-bearing friction torque T2 is represented by a following expression (1).

$$\text{The lower-restoring torque } TR1 \leq 0 \quad (1)$$

The lower-restoring torque TR1 is the sum of the rotating-body friction torque T1 and the lower-bearing friction torque T2 in the polar coordinate system with its origin located on the rotational center CP (i.e., TR1=T1+T2).

The lower-restoring torque TR1 is a tilting torque that attempts to tilt the dresser 7 around the rotational center CP to thereby press the dresser 7 against the polishing pad 10. In the above-described polar coordinate system, the lower-bearing friction torque T2 takes positive numbers, and the rotating-body friction torque T1 takes negative numbers. In such a polar coordinate system, when the lower-restoring torque TR1 is larger than 0, the dresser 7 attempts to tilt in a direction opposite to the moving direction of the polishing pad 10. Accordingly, the peripheral portion of the dresser 7 tends to sink into the polishing pad 10, and thus, an attitude of the dresser 7 becomes unstable. As a result, the vibration may occur in the dresser 7. In contrast, when the lower-restoring torque TR1 is equal to or less than 0, the dresser 7 attempts to tilt toward the moving direction of the polishing pad 10, while the polishing pad 10 goes away from the peripheral portion of the dresser 7. Therefore, a state in which the peripheral portion of the dresser 7 sinks into the polishing pad 10 is not induced, so that the attitude of the dresser 7 becomes stable. As a result, the vibration of the dresser 7 can be prevented.

Unlike such a polar coordinate system, if assuming a polar coordinate system in which, when the polishing pad 10 moves from right side to left side at a speed (+V), the lower-bearing friction torque T2 takes negative numbers and the rotating-body friction torque T1 takes positive numbers, it should be noted that the direction of the inequality sign in the above-described stability condition expression (1) is reversed (i.e., The lower-restoring torque TR1≥0).

As described above, the magnitude of the rotating-body friction torque T1 changes depending on the gimbal-axis height h that is a distance from the lower end surface of the dresser 7 to the rotational center CP. On the other hand, the lower-bearing friction torque T2 changes depending on the lower-bearing radius R2 that is a distance between the third concave contact surface 54*b* and the fourth convex contact surface 56*a*, and the rotational center CP. Therefore, in this embodiment, the lower-bearing radius R2 that can satisfy the stability condition expression (1) is determined to thereby prevent the vibration of the dresser 7 caused by the lower-bearing friction torque T2. Hereinafter, an example of simulations for determining the lower-bearing radius R2 that can satisfy the stability condition expression (1) will be described.

Figure 5A:
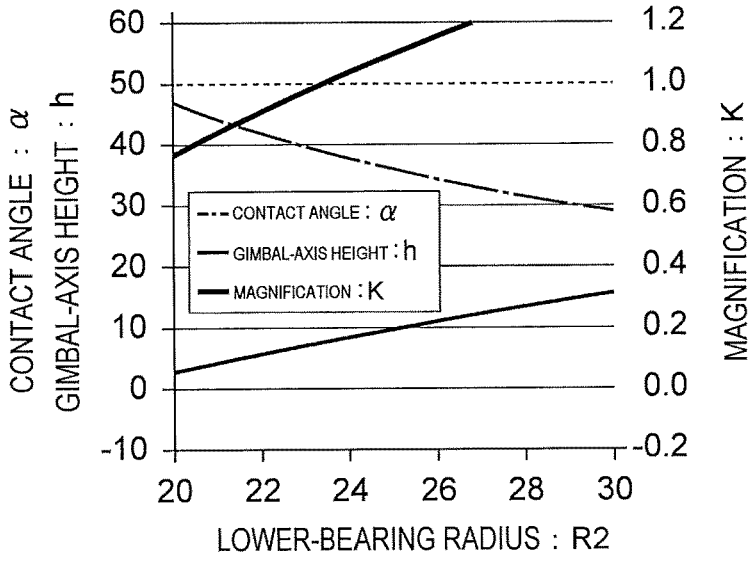
FIGS. 5A through 5C are graphs each showing simulation results for determining a lower-bearing radius.
Figure 5B:
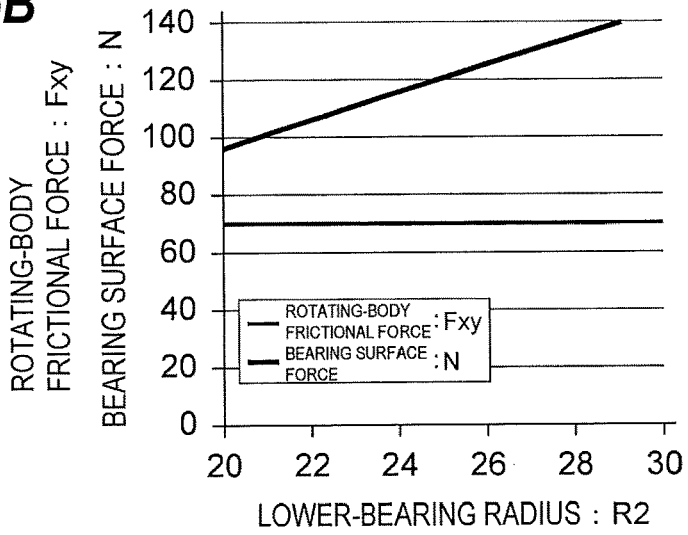
Figure 5C:
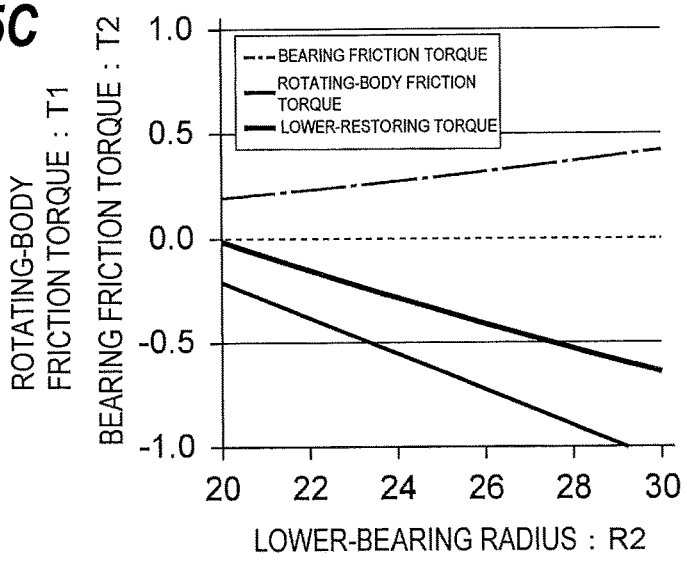

FIG. 5A is a graph showing simulation results of the contact angle α, the gimbal-axis height h, and a magnification K with respect to the lower-bearing radius R2 of the lower spherical bearing 55, FIG. 5B is a graph showing simulation results of the rotating-body frictional force Fxy and the lower-bearing surface force N with respect to the lower-bearing radius R2, and FIG. 5C is a graph showing simulation results of the rotating-body friction torque T1, the lower-bearing friction torque T2, and the lower-restoring torque TR1 with respect to the lower-bearing radius R2. The simulations, results of which are shown in FIGS. 5A through 5C, were performed under the following simulation conditions.

Simulation Conditions

The pressing force DF=78 N

The rotating-body coefficient of friction COF1=0.9

The lower-bearing coefficient of friction COF2=0.1

Each of the rotating-body coefficient of friction COF1 and the lower-bearing coefficient of friction COF2 was set based on the experiences of the present inventors.

A left vertical axis in FIG. 5A represents the contact angle α or the gimbal-axis height h, and a right vertical axis in FIG. 5A represents the magnification K. A horizontal axis in FIG. 5A represents the lower-bearing radius R2. In FIG. 5A, the contact angle α is represented by a chain line, and the gimbal-axis height h is represented by a thin solid line. A thick solid line represents the magnification K, which will be described later. A vertical axis in FIG. 5B represents the rotating-body frictional force Fxy or the lower-bearing surface force N, and a horizontal axis in FIG. 5B represents the lower-bearing radius R2. In FIG. 5B, the rotating-body frictional force Fxy is represented by a thin solid line, and the lower-bearing surface force N is represented by a thick solid line. A vertical axis in FIG. 5C represents the rotating-body friction torque T1, the lower-bearing friction torque T2, or the lower-restoring torque TR1, and a horizontal axis in FIG. 5C represents the lower-bearing radius R2. In FIG. 5C, the rotating-body friction torque T1 is represented by a thin solid line, the lower-bearing friction torque T2 is represented by a chain line, and the lower-restoring torque TR1 is represented by a thick solid line.

A width of the insertion recess 35*b* of the sleeve 35 in the radial direction of the dresser 7 is appropriately determined based on a diameter of the dresser 7 and a size of the dresser disk 31. Since the lower spherical bearing 55 (and the upper spherical bearing 52) is stored into the insertion recess 35*b* of the sleeve 35, a width of the lower spherical bearing 55 (and the upper spherical bearing 52) in the radial direction of the dresser 7 is determined in advance at a predetermined value corresponding to the width of the insertion recess 35*b*. In this simulation, when the lower-bearing radius R2 of the lower spherical bearing 55 is changed in a state where the width of the lower spherical bearing 55 in the radial direction of the dresser 7 is fixed at the predetermined value, each value of the contact angle α, the gimbal-axis height h, the magnification K, the lower-bearing surface force N, the rotating-body friction torque T1, the lower-bearing friction torque T2, and the lower-restoring torque TR1 was calculated.

As shown in FIG. 5A, with increasing the lower-bearing radius R2 of the lower spherical bearing 55, the gimbal-axis height h is increased. More specifically, the rotational center CP travels away from the lower end surface of the dresser 7 downward. Further, with increasing the lower-bearing radius R2 of the lower spherical bearing 55, the contact angle α is decreased.

The rotating-body frictional force Fxy is determined by the rotating-body coefficient of friction COF1 between the dresser 7 and the polishing pad 10, and the pressing force DF. Therefore, as shown in FIG. 5B, if the lower-bearing radius R2 is changed, the rotating-body frictional force Fxy is constant (i.e., not changed). On the other hand, as shown in FIG. 5C, the rotating-body friction torque T1 is the product of the rotating-body frictional force Fxy by the gimbal-axis height h, and thus, is increased with increasing the gimbal-axis height h (i.e., the lower-bearing radius R2).

As shown in FIG. 5B, with decreasing the contact angle α, the lower-bearing surface force N is increased. The lower-bearing friction torque T2 is the product of the lower-bearing surface force N by the lower-bearing radius R2, and hence, as shown in FIG. 5C, the lower-bearing frictional force T2 is increased with increasing the lower-bearing surface force N.

In this embodiment, the lower-bearing radius R2 is determined so that the rotating-body friction torque T1 that is generated during dressing the polishing pad 10 with use of the dresser 7 causes the lower-bearing friction torque T2 to be cancelled. In order to prevent the vibration of the dresser 7, as shown by the stability condition expression (1), the lower-restoring torque TR1 that is the sum of the rotating-body friction torque T1 and the lower-bearing friction torque T2 needs to be equal to or less than 0 in the polar coordinate system with its origin located on the rotational center CP.

As shown in FIG. 5C, a value of the lower-bearing radius R2 when the lower-restoring torque TR1 becomes 0 is 20 mm, and therefore, if the lower-bearing radius R2 is equal to or more than 20 mm, the lower-bearing torque TR1 becomes equal to or less than 0. Therefore, from these simulation results, it can be understood that, when the lower-bearing radius R2 is set to 20 mm or more, the occurrence of the vibration of the dresser 7 can be effectively prevented. In these simulations, when the lower-bearing radius R2 is 20 mm, the gimbal-axis height h is 3 mm, and the magnification K, which will be described later, is 0.79.

In this specification, the magnification K is defined as follows. The magnification K is a ratio of the lower-bearing surface force N at the point of application OP (see FIG. 4) to the rotating-body frictional force Fxy. The magnification K is obtained from the following expression (2).

$$K=1/[\sin(\alpha)+COF2\cdot\cos(\alpha)] \quad (2)$$

As described with reference to FIG. 4, a magnitude of N·sin(α) that is a force component of the lower-bearing surface force N in the horizontal direction is proportional to the rotating-body frictional force Fxy. Specifically, a relationship of the following expression (3) is established between the rotating-body frictional force Fxy and the lower-bearing surface force N.

$$Fxy=N\cdot\sin(\alpha)+N\cdot COF2\cdot\cos(\alpha) \quad (3)$$

In the expression (3), a term "N·COF2·cos(α)" is a force component of the lower-bearing frictional force F1 in the horizontal direction.

With decreasing the contact angle α, the lower-bearing surface force N is increased. When the lower-bearing surface force N increases, N·cos(α) that is a force component of the lower-bearing surface force N in the vertical direction is increased. When N·cos(α) becomes larger than the pressing force DF, the rotating-body frictional force Fxy cannot be supported only by the lower spherical bearing 55, so that the rotating-body frictional force Fxy begins to act on the upper spherical bearing 52. Accordingly, it is preferred that the lower-bearing radius R2 is set so as to provide the magnification K which does not exceed 1.0. In these simulations, when the lower-bearing radius R2 is equal to or more than 24.5 mm, the magnification K exceeds 1.0. Therefore, the lower-bearing radius R2 is preferably set within a range of 20 mm to 24.5 mm. When the lower-bearing radius R2 is 24.5 mm, the contact angle α is 37 degrees.

When the magnification K exceeds 1.0, the rotating-body frictional force Fxy acts on the upper spherical bearing 52, causing an upper-bearing frictional force to be generated between the first concave contact surface 53*a* and the second convex contact surface 54*a* of the upper spherical bearing 52. The upper-bearing frictional force generated in the upper spherical bearing 52 causes an upper-bearing friction torque that attempts to rotate the dresser (rotating body) 7 around the rotational center CP to be generated.

Although not shown, the upper-bearing friction torque is generated according to the same principles as the lower-bearing friction torque described with reference to FIG. 4. More specifically, since the rotating-body frictional force Fxy is mainly applied to an outer end (or near an outer end) of the upper spherical bearing 52, a point of application at which the rotating-body frictional force Fxy is applied to the upper spherical bearing 52, is set to the outer end (near the outer end) of the upper spherical bearing 52. On this point of application of the upper spherical bearing 52, the second convex contact surface 54*a* is pressed against the first concave contact surface 53*a* at the rotating-body frictional force Fxy in the horizontal direction, and as a result, a reaction force to the rotating-body frictional force Fxy is generated on the first concave contact surface 53*a*. The reaction force to the rotating-body frictional force Fxy, which has been generated on the first concave contact surface 53*a*, causes an upper-bearing surface force to be generated in a perpendicular direction to a tangential line at the point of application of the upper spherical bearing 52.

The upper-bearing surface force generated in the upper spherical bearing 52 causes an upper-bearing frictional force to be generated between the first concave contact surface 53*a* and the second convex contact surface 54*a*. As a result, an upper-bearing friction torque due to the upper-bearing frictional force is generated in the dresser 7. The upper-bearing frictional force is a force applied in the tangential direction at the point of application where the rotating-body frictional force Fxy is applied to the upper spherical bearing 52, and a magnitude of the upper-bearing frictional force is obtained by multiplying the upper-bearing surface force by a coefficient of friction between the first concave contact surface 53*a* and the second convex contact surface 54*a*. For convenience in description, hereinafter, the upper-bearing surface force will be referred to as "an upper-bearing surface force N'", the upper-bearing frictional force will be referred to as "an upper-bearing frictional force F2", and the coefficient of friction between the first concave contact surface 53*a* and the second convex contact surface 54*a* will be referred to as "an upper-bearing coefficient of friction COF3".

The upper-bearing coefficient of friction COF3 may be estimated based on experiences of designer of the coupling mechanism 50, or may be obtained from experiments and the like. In an embodiment, a measuring device capable of measuring the upper-bearing coefficient of friction COF3 may be made, and the upper-bearing coefficient of friction COF3 may be practically measured by using this measuring device.

The upper-bearing frictional force F2 causes an upper-bearing friction torque, which attempts to rotate the dresser 7 around the rotational center CP and in a direction opposite to the rotating-body friction torque T1, to be generated. For convenience in description, hereinafter, the upper-bearing friction torque will be referred to as "an upper-bearing friction torque T3". The upper-bearing friction torque T3 is obtained by multiplying the upper-bearing frictional force F2 by the upper-bearing radius R1 (i.e., T3=F2·R1). The upper-bearing friction torque T3 acts in the opposite direction to the rotating-body friction torque T1. Therefore, in the above-described polar coordinate system with its origin located on the rotational center CP, the upper-bearing friction torque T3 takes positive numbers.

When the magnification K in the lower spherical bearing 55 exceeds 1.0, the upper-bearing friction torque T3 may be generated, thereby causing the vibration of the dresser 7 to occur. In view of this, it is preferred that the upper-bearing radius R1 is determined in consideration of the magnification K. Hereinafter, simulations for determining the upper-bearing radius R1 will be described.

As with the stability condition expression (1) for the dresser 7 due to the lower-bearing friction torque T2, a stability condition expression for the dresser 7 due to the upper-bearing friction torque T3 can be represented by the following expression (4).

$$\text{An upper-restoring torque } TR2 \leq 0 \quad (4)$$

The upper-restoring torque TR2 is the sum of the rotating-body friction torque T1 and the upper-bearing friction torque T3 in the polar coordinate system with its origin located on the rotational center CP (i.e., TR2=T1+T3).

In the above-described polar coordinate system, when the polishing pad 10 moves at a velocity (+V) from a right side to a left side relative to the dresser 7, the upper-bearing friction torque T3 takes positive numbers, and the rotating-body friction torque T1 takes negative numbers. In such a polar coordinate system, when the upper-restoring torque TR2 is larger than 0, the dresser 7 attempts to tilt in a direction opposite to the moving direction of the polishing pad 10. Accordingly, the peripheral portion of the dresser 7 tends to sink into the polishing pad 10, and thus, the attitude of the dresser 7 becomes unstable. As a result, the vibration may occur in the dresser 7. In contrast, when the upper-restoring torque TR2 is equal to or less than 0, the dresser 7 attempts to tilt toward the moving direction of the polishing pad 10, while the polishing pad 10 goes away from the peripheral portion (edge portions) of the dresser 7. Therefore, a state in which the peripheral portion of the dresser 7 sinks into the polishing pad 10 is not induced, so that the attitude of the rotating body becomes stable. As a result, the vibration of the dresser 7 can be prevented.

Unlike such a polar coordinate system, if assuming a polar coordinate system in which, when the polishing pad 10 moves from right to left at a speed (+V), the upper-bearing friction torque T3 takes negative numbers and the rotating-body friction torque T1 takes positive numbers, it should be noted that the direction of the inequality sign in the above-described stability condition expression (4) is reversed (i.e., The upper-restoring torque TR2≥0).

Figure 6A:
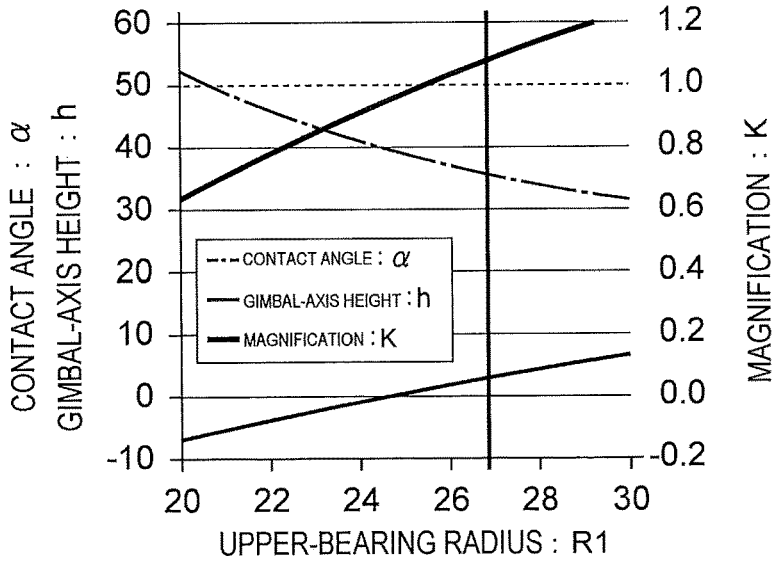
FIGS. 6A through 6C are graphs each showing simulation results for an upper spherical bearing, which were performed under the same simulation conditions as those of the simulations whose results are shown in the FIGS. 5A through 5C.
Figure 6B:
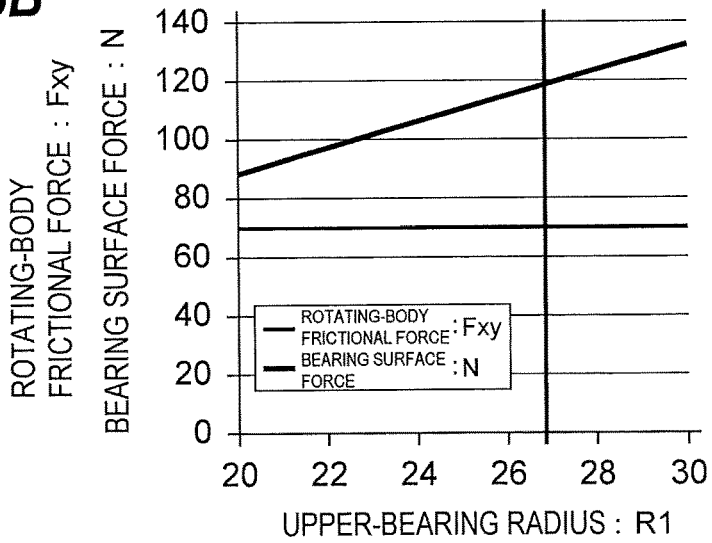
Figure 6C:
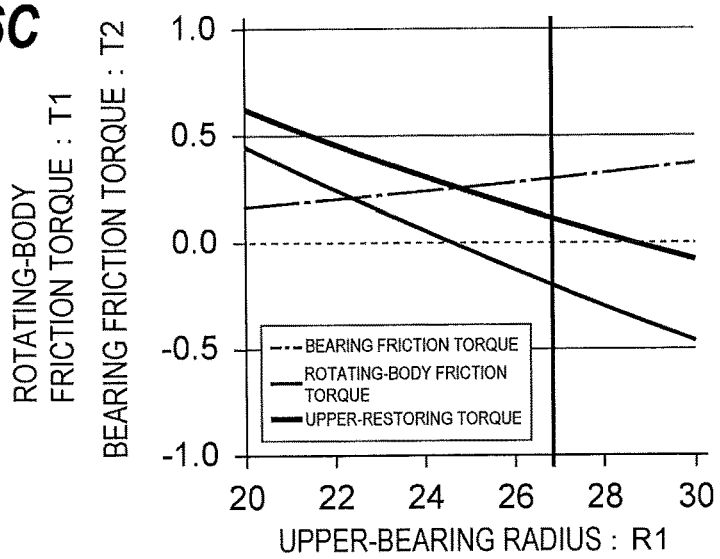

FIGS. 6A through 6C are graphs each showing simulation results for the upper spherical bearing, which has been performed under the same conditions as the simulations whose results are illustrated by FIGS. 5A through 5C. More specifically, FIG. 6A is a graph showing simulation results of a contact angle α, the gimbal-axis height h, and a magnification K with respect to the upper-bearing radius R1 of the upper spherical bearing 52, FIG. 6B is a graph showing simulation results of the rotating-body frictional force Fxy and the upper-bearing surface force N' with respect to the upper-bearing radius R1, and FIG. 6C is a graph showing simulation results of the rotating-body friction torque T1, the upper-bearing friction torque T3, and the upper-restoring torque TR2 with respect to the upper-bearing radius R1.

A left vertical axis in FIG. 6A represents the contact angle α or the gimbal-axis height h, and a horizontal axis in FIG. 6A represents the upper-bearing radius R1. In FIG. 6A, the contact angle α is represented by a chain line, and the gimbal-axis height h is represented by a thin solid line. A thick solid line represents the magnification K in the upper spherical bearing 52. A vertical axis in FIG. 6B represents the rotating-body frictional force Fxy or the upper-bearing surface force N', and a horizontal axis in FIG. 6B represents the upper-bearing radius R1. In FIG. 6B, the rotating-body frictional force Fxy is represented by a thin solid line, and the upper-bearing surface force N' is represented by a thick solid line. A vertical axis in FIG. 6C represents the rotating-body friction torque T1, the upper-bearing friction torque T3, or the upper-restoring torque TR2, and a horizontal axis in FIG. 6C represents the upper-bearing radius R1. In FIG. 6C, the rotating-body friction torque T1 is represented by a thin solid line, the upper-bearing friction torque T3 is represented by a chain line, and the upper-restoring torque TR2 is represented by a thick solid line.

The simulations, results of which are shown in FIGS. 6A through 6C, were performed under the following simulation conditions.

Simulation Conditions

The pressing force DF=78 N

The rotating-body coefficient of friction COF1=0.9

The upper-bearing coefficient of friction COF3=0.1

Each of the rotating-body coefficient of friction COF1 and the upper-bearing coefficient of friction COF3 was set based on the experiences of the present inventors.

First, the lower-bearing radius R2 is determined from the simulation results illustrated in FIGS. 5A through 5C. In this embodiment, the lower-bearing radius R2 is determined to be 20 mm, which is a value of the lower-bearing radius when the lower-restoring torque TR1 becomes 0 (see FIG. 5C). Next, the gimbal-axis height h is determined based on the lower-bearing radius R2 determined. When the lower-bearing radius R2 is 20 mm, the gimbal-axis height h is 3 mm (see FIG. 5A). Next, with reference to FIG. 6A, the upper-bearing radius R1 when the gimbal-axis height h is 3 mm is determined. From the FIG. 6A, it can be seen that the upper-bearing radius R1 when the gimbal-axis height h is 3 mm is 27 mm. In this manner, the upper-bearing radius R1 is determined.

Next, with referring to FIG. 6C, a value of the upper-restoring torque TR2 when the upper-bearing radius R1 is 27 mm is checked. From FIG. 6C, it can be seen that a value of the upper-restoring torque TR2 when the upper-bearing radius R1 is 27 mm is larger than 0.

In this embodiment, the magnification K when the lower-bearing radius R2 is 20 mm is equal to or less than 1.0. Accordingly, the rotating-body frictional force Fxy is considered to have little effect on the upper-spherical bearing 52. Therefore, even though the upper-restoring torque TR2 is larger than 0, the lower-bearing radius R2 can be determined to be 20 mm, and the upper-bearing radius R1 can be determined to be 27 mm.

However, in the above-described simulations, the value of the lower-bearing coefficient of friction COF2 (=1.0) is an assumed value. Further, the lower-restoring torque TR1 when the lower-bearing radius R2 is 20 mm is 0. Therefore, even though the lower-bearing coefficient of friction COF2 only becomes slightly larger than 0.1, the above-described stability condition expression (1) may not be satisfied. Specifically, even though the lower-bearing coefficient of friction COF2 only becomes slightly larger than 0.1, the vibration may occur in the dresser 7.

Figure 7A:
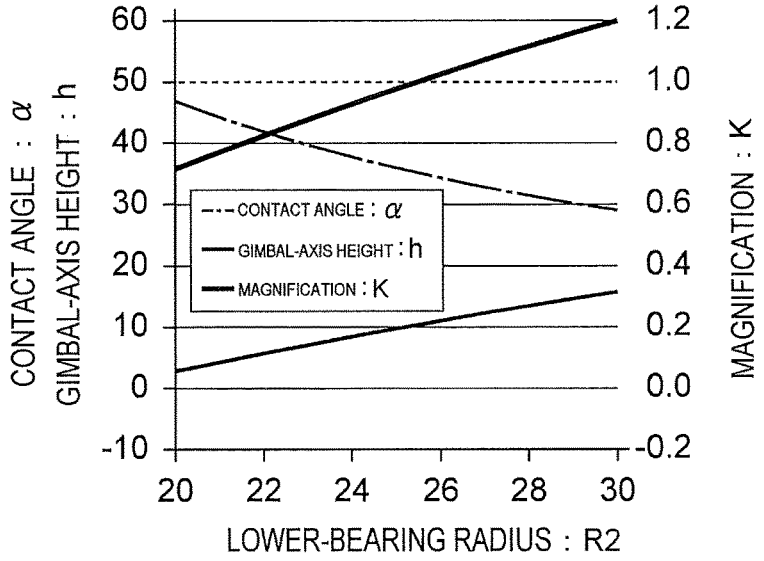
FIGS. 7A through 7C are graphs each showing another simulation results for determining the lower-bearing radius.
Figure 7B:
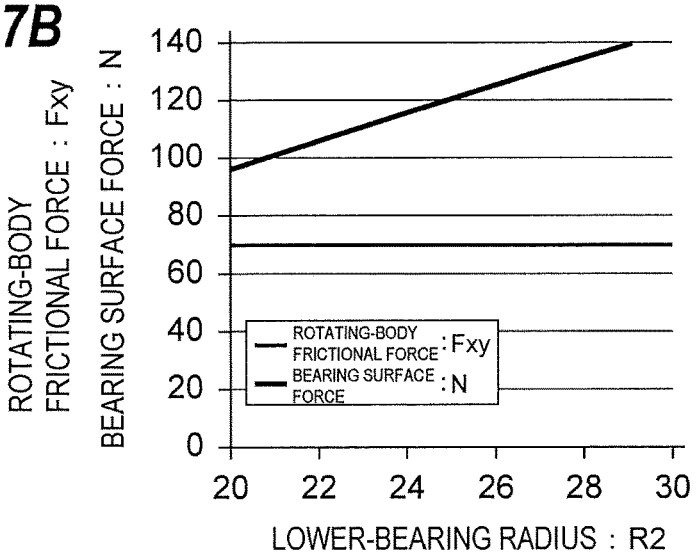
Figure 7C:
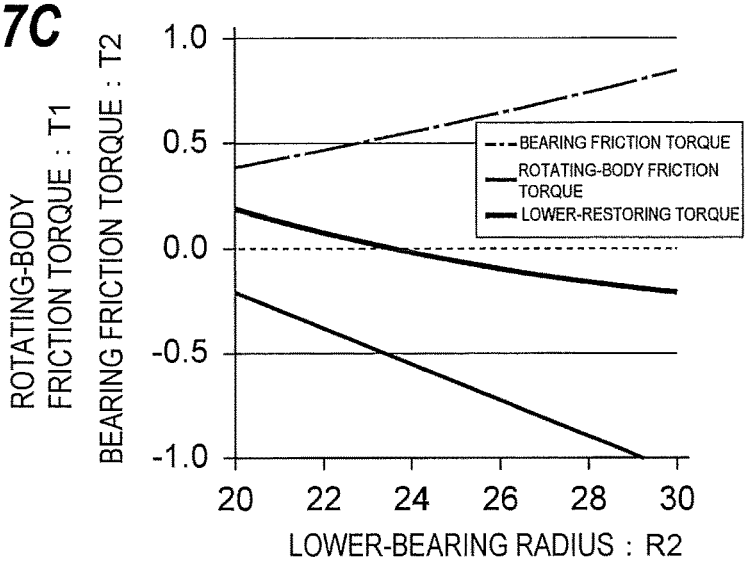

In view of this, the lower-bearing coefficient of friction COF2 was set to 0.2, and simulations were performed again. FIGS. 7A through 7C are graphs each showing another simulation results for determining the lower-bearing radius. Simulation conditions used in simulations whose results are shown in FIGS. 7A through 7C, are different from those used in the simulations whose results are shown in FIGS. 5A through 5C, only in that the lower-bearing coefficient of friction is increased. More specifically, the lower-bearing coefficient of friction COF2 in the simulations whose results are shown in FIGS. 7A through 7C, was set to 0.2, and simulation conditions, except for the lower-bearing coefficient of friction COF2, were identical to those used in the simulations whose results are shown in FIGS. 5A through 5C.

As shown in FIG. 7C, it can be seen that, when the lower-bearing coefficient of friction COF2 is set to 0.2, each value of the lower-bearing friction torque T2 is larger than that of the lower-bearing friction torque T2 shown in FIG. 5C. Further, the lower-bearing radius R2 when the lower-restoring torque TR1 becomes 0 is 24 mm, and it can be seen that, if the lower-bearing radius R2 is set to 20 mm, the stability condition expression (1) is not satisfied. Therefore, when the lower-bearing coefficient of friction COF2 is set to 0.2, the lower-bearing radius cannot be determined to be 20 mm.

Figure 8A:
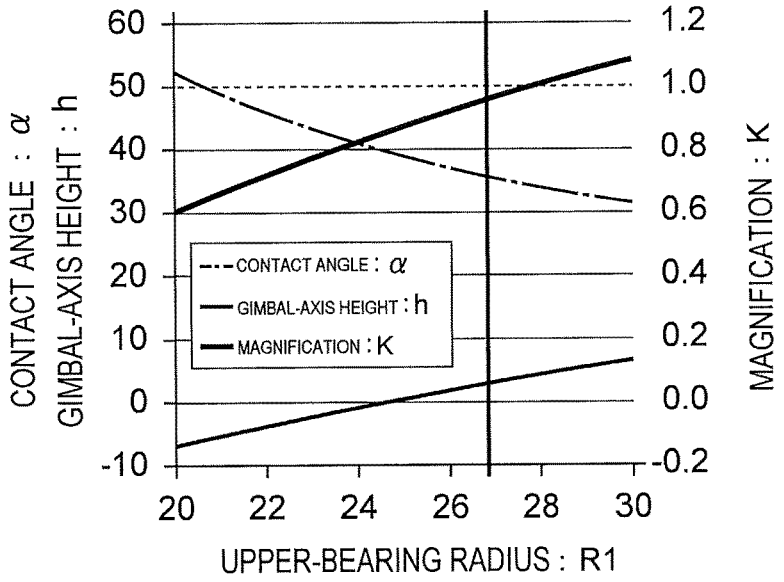
FIGS. 8A through 8C are graphs each showing simulation results for determining an upper-bearing radius, which were performed under the same simulation conditions as those of the simulations whose results are shown in FIGS. 7A through 7C.
Figure 8B:
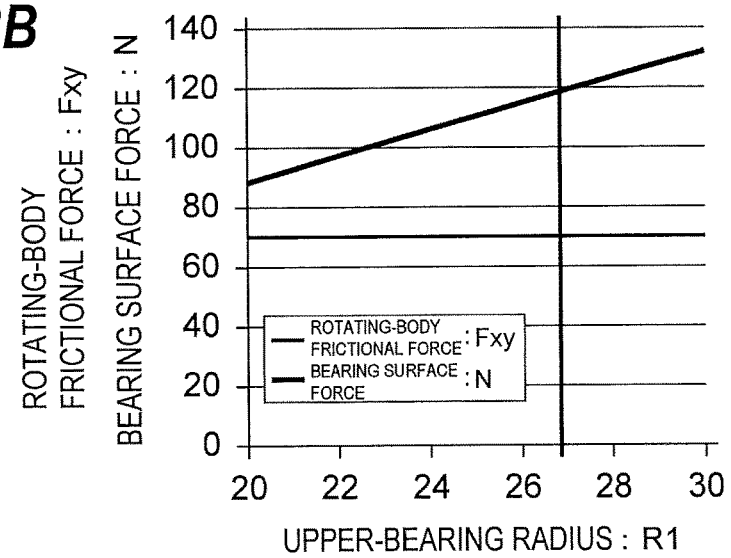
Figure 8C:
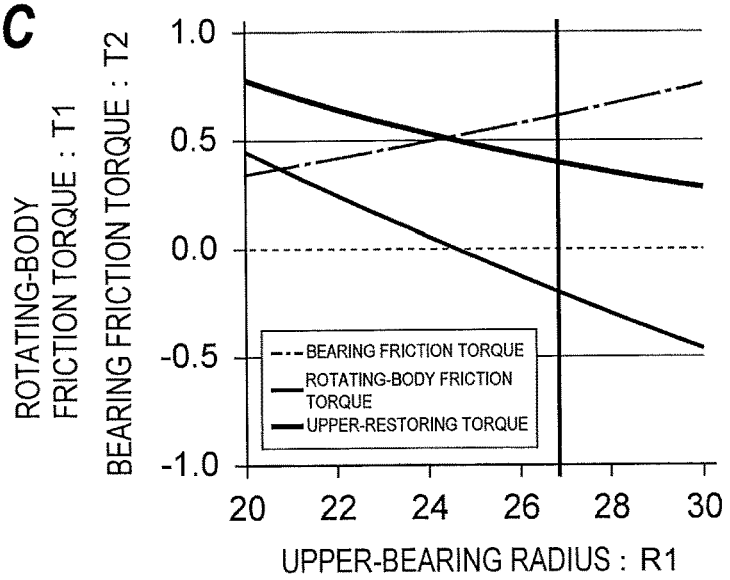

FIGS. 8A through 8C are graphs each showing simulation results for determining the upper-bearing radius, which were performed under the same conditions as those of the simulations whose results are shown in FIGS. 7A through 7C. FIGS. 8A through 8C correspond to FIGS. 7A through 7C, respectively, and descriptions for a vertical axis and a horizontal axis in each drawing are omitted.

As described above, when the lower-bearing coefficient of friction COF2 is set to 0.2, the lower-bearing radius R2 cannot be determined to be 20 mm. However, just to make sure, it is preferred that the upper-restoring torque TR2 when the lower-bearing radius R2 is 20 mm is checked.

As described above, when the lower-bearing radius R2 is 20 mm, the gimbal-axis height h is 3 mm, and the upper-bearing radius R1 corresponding to this gimbal-axis height h (=3 mm) is 27 mm. From FIG. 8C, it can be seen that the upper-restoring torque TR2 when the upper-bearing radius R1 is 27 mm is larger than 0. Therefore, it is understood that the upper-bearing radius R1 cannot be determined to be 27 mm.

In this manner, if the lower-bearing coefficient of friction COF2 is set to 0.2, the lower-bearing radius R2 cannot be determined to be 20 mm. Therefore, it is necessary to redetermine the lower-bearing radius R2 that can satisfy the stability condition expression (1) when the lower-bearing fictional coefficient COF is 0.2.

Figure 9A:
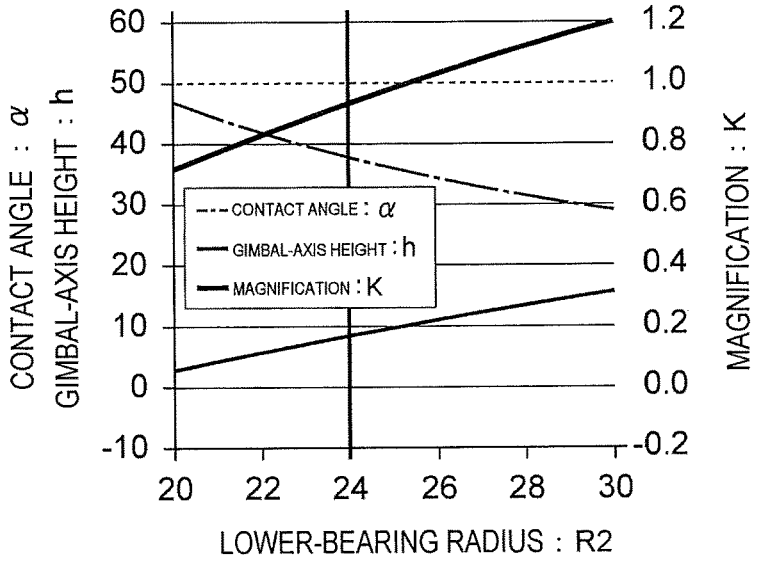
FIGS. 9A through 9C are graphs each showing explicitly the lower-bearing radius at which the lower-restoring torque is 0 in the graphs shown in FIGS. 7A through 7C.
Figure 9B:
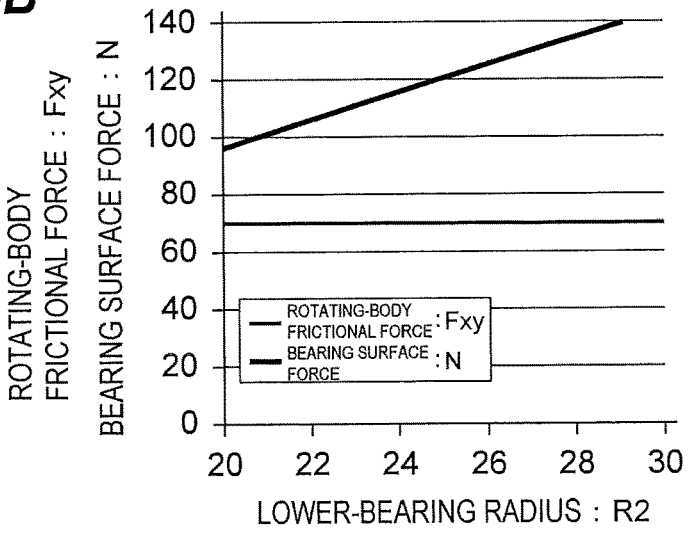
Figure 9C:
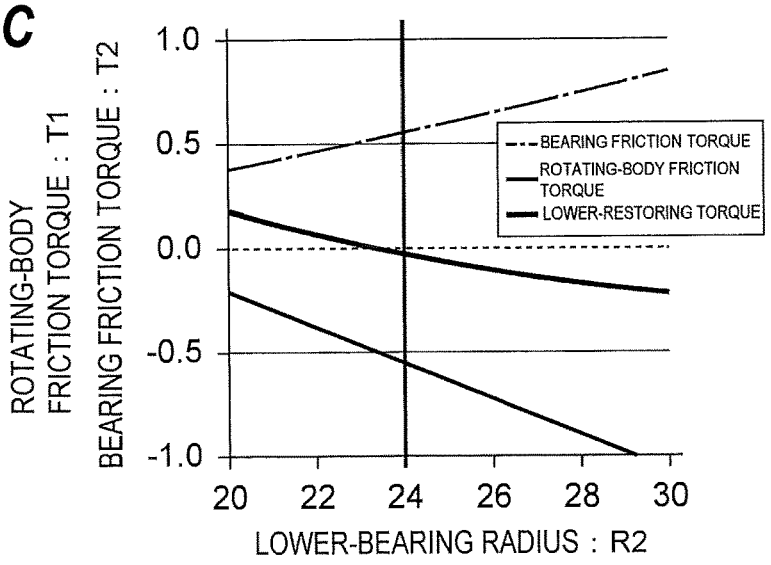

FIGS. 9A through 9C are graphs each showing explicitly the lower-bearing radius R2 at which the lower-restoring torque TR1 becomes 0 in the graphs shown in FIGS. 7A through 7C. As shown in FIG. 9C, when the lower-bearing radius R2 is 24 mm, the lower-restoring torque TR1 is equal to or less than 0. Therefore, when it is assumed that the lower-bearing coefficient of friction COF2 is 0.2, it is understood that a value of the lower-bearing radius R2 that can satisfy the stability condition expression (1) is equal to or more than 24 mm.

Further, from FIG. 9A, it can be seen that, when the lower-bearing radius R2 is 24 mm, the gimbal-axis height h is 9.6 mm, and the magnification K is equal to or less than 1.0.

Figure 10A:
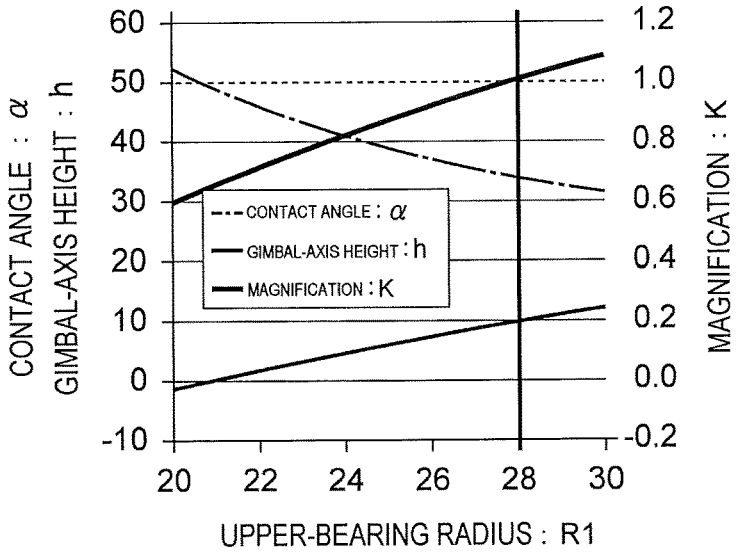
FIGS. 10A through 10C are graphs each showing explicitly the upper-bearing radius when the lower-bearing radius is 24 mm in the graphs shown in FIGS. 8A through 8C.
Figure 10B:
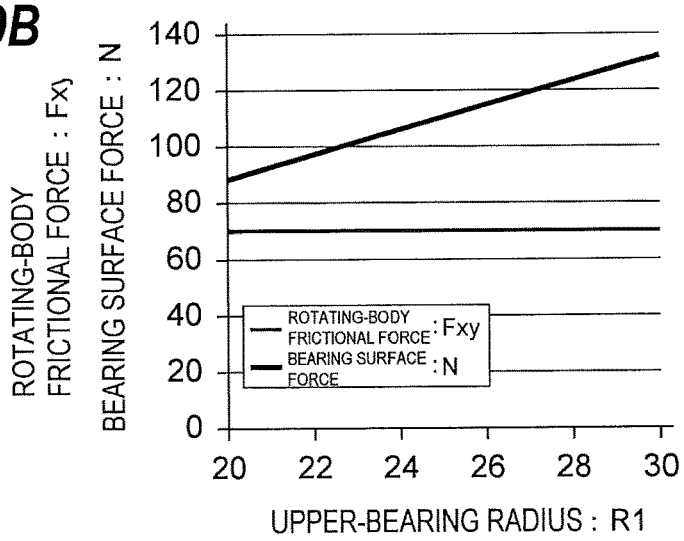
Figure 10C:
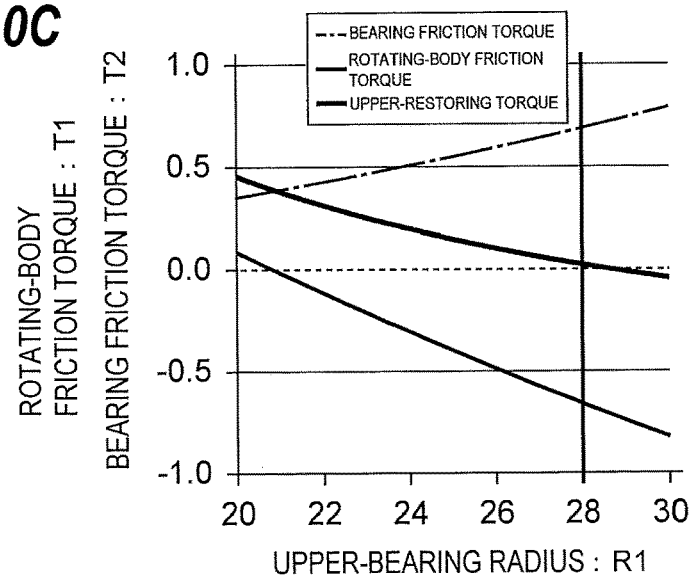

FIGS. 10A through 10C are graphs each showing explicitly the upper-bearing radius R1 when the lower-bearing radius R2 is 24 mm in the graphs shown in FIGS. 8A through 8C. As shown in FIG. 10A, the upper-bearing radius R1 when the gimbal-axis height h is 9.6 mm is 28 mm. As shown in FIG. 10C, the upper-restoring torque TR2 when the upper-bearing radius R1 is 28 mm is 0, and therefore, it can be seen that the above-described stability condition expression (4) also is satisfied.

In this manner, the lower-bearing radius R2 and the upper-bearing radius R1 are determined so as to simultaneously satisfy the stability condition expressions (1) and (4), so that the vibration of the dresser (rotating body) 7 can be prevented more effectively.

Figure 11A:
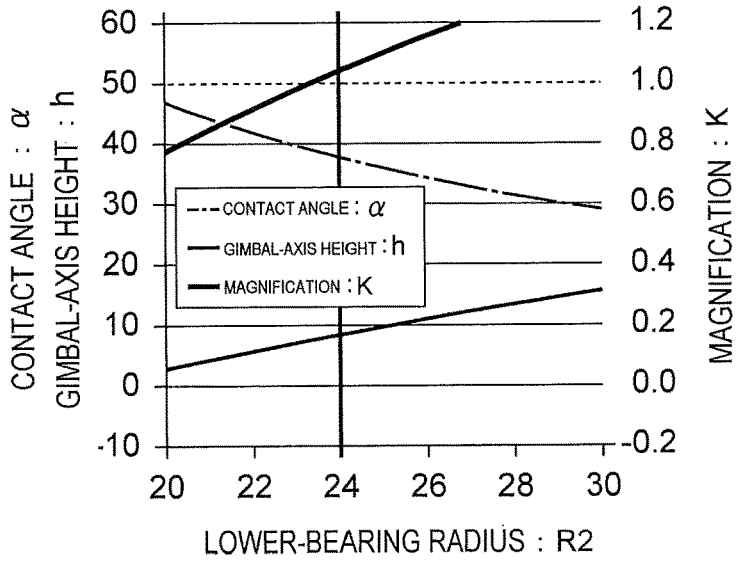
FIGS. 11A through 11C are graphs each showing simulation results which were, except that the lower-bearing coefficient of friction COF2 was set to 0.1, performed under the same simulation conditions as those of simulations whose results are shown in FIGS. 9A through 9C.
Figure 11B:
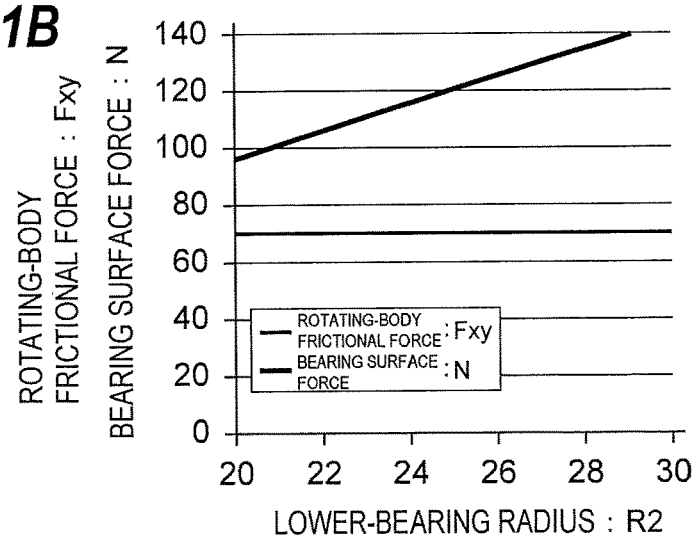
Figure 11C:
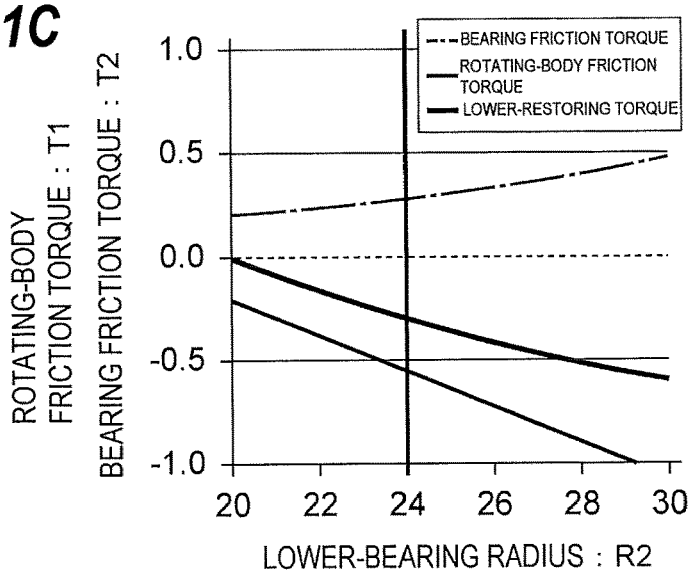
Figure 12A:
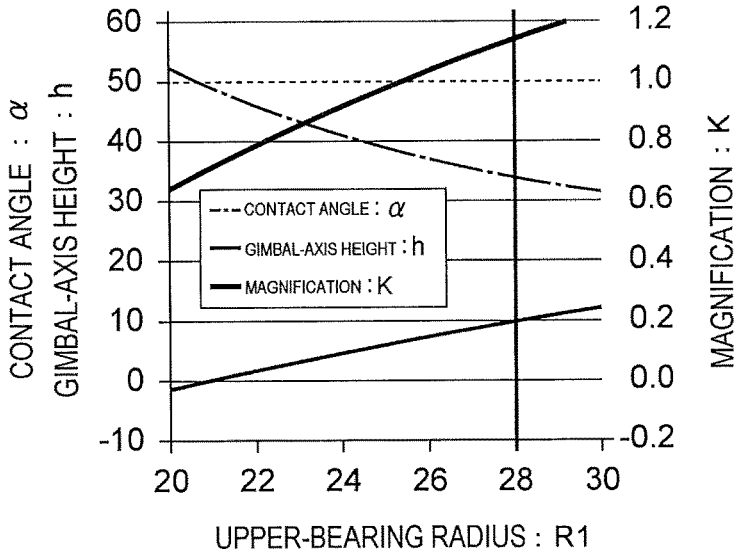
FIGS. 12A through 12C are graphs each showing simulation results which were performed under the same simulation conditions as those of the simulations whose results are shown in FIGS. 11A through 11C.
Figure 12B:
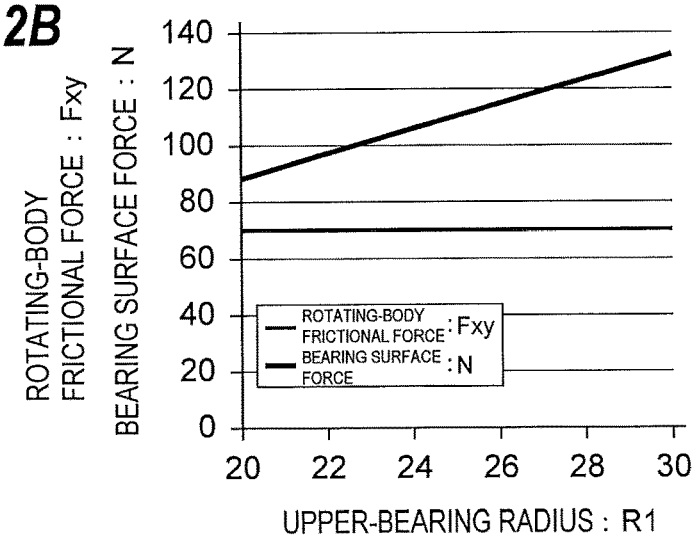
Figure 12C:
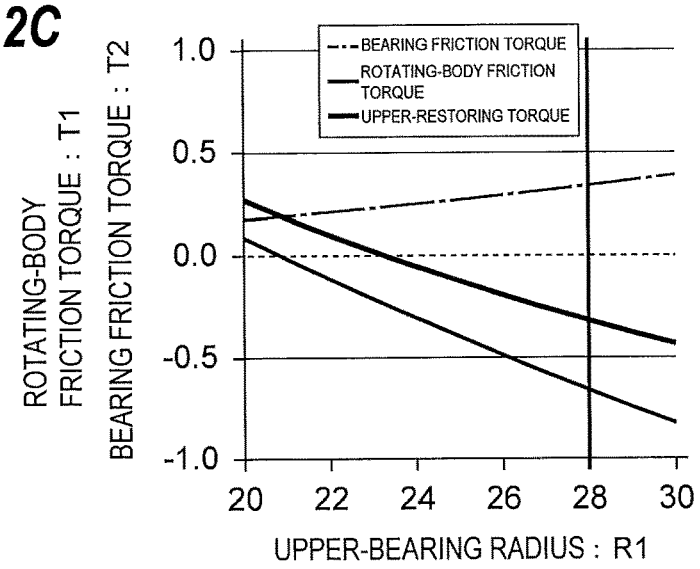

FIGS. 11A through 11C are graphs each showing simulation results which were, except that the lower-bearing coefficient of friction COF2 was set to 0.1, performed under the same simulation conditions as those of the simulations whose results are shown in FIGS. 9A through 9C. FIGS. 12A through 12C are graphs each showing simulation results which were performed under the same simulation conditions as those of the simulations whose results are shown in FIGS. 11*a* through 11C.

It can be seen from FIGS. 11A through 11C that, when the lower-bearing radius R2 is determined to be 24 mm, the lower-restoring torque TR1 is equal to or less than 0, and the magnification K is equal to or less than 1.0. Further, it can be seen from FIGS. 12A through 12C that, when the upper-bearing radius R1 is determined to be 28 mm, the upper-restoring torque TR2 is equal to or less than 0. Therefore, it can be understood that, even though the lower-bearing coefficient of friction COF2 is set to 0.1, the stability condition expressions (1) and (4) are satisfied simultaneously.

In this manner, the lower-bearing radius R2 is determined so as to satisfy the stability condition expression (1). In this case, the lower-bearing radius R2 is preferably determined in consideration of the magnification K. Further, when the magnification K exceeds 1.0, it is preferred that the upper-bearing radius R1 is determined so as to satisfy the stability condition expression (4).

Figure 13:
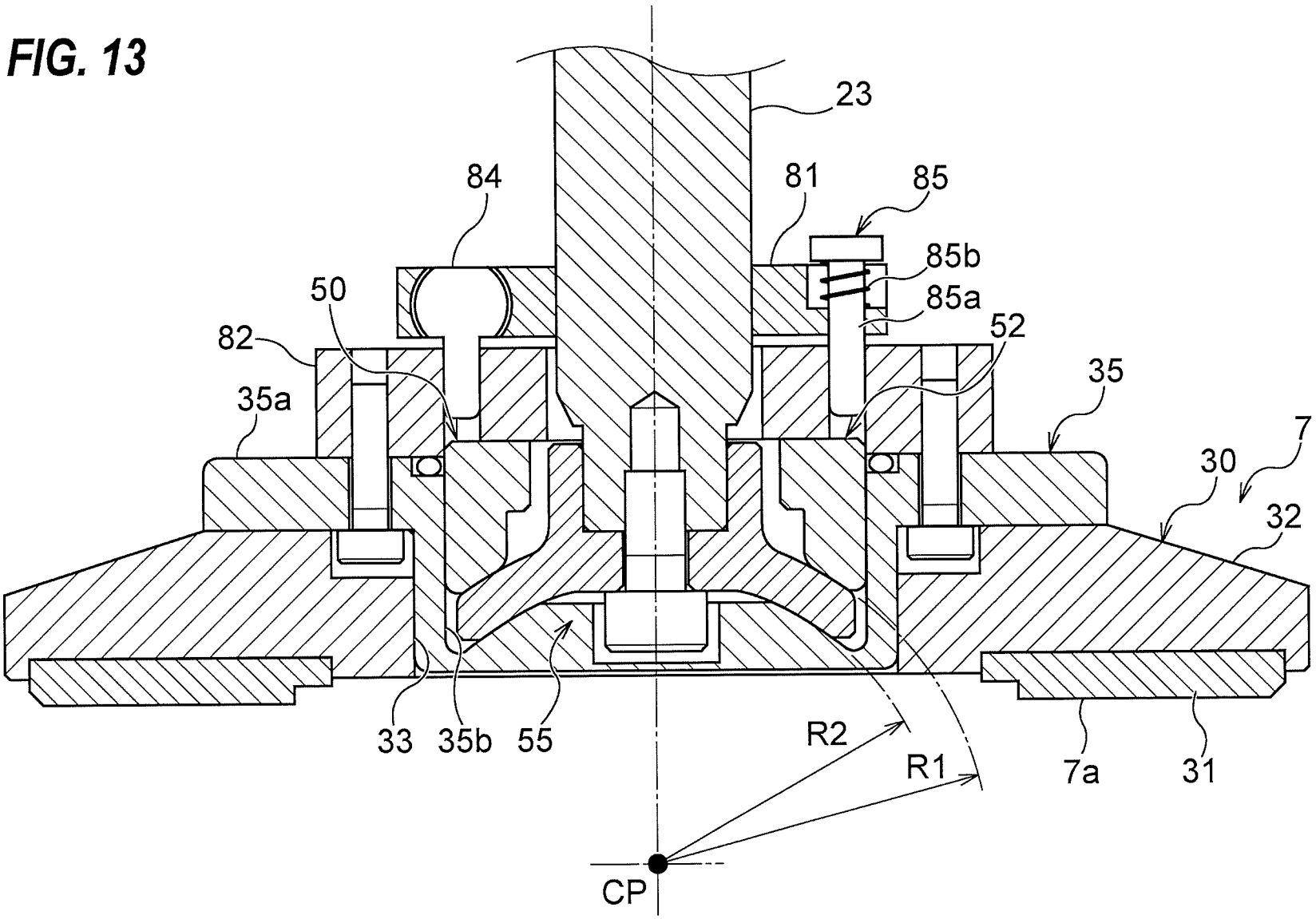
FIG. 13 is a schematic view showing a manner where the dresser is coupled to the dresser shaft through the coupling mechanism in which the lower-bearing radius is set to 24 mm, and the upper-bearing radius is set to 28 mm.
Figure 14:
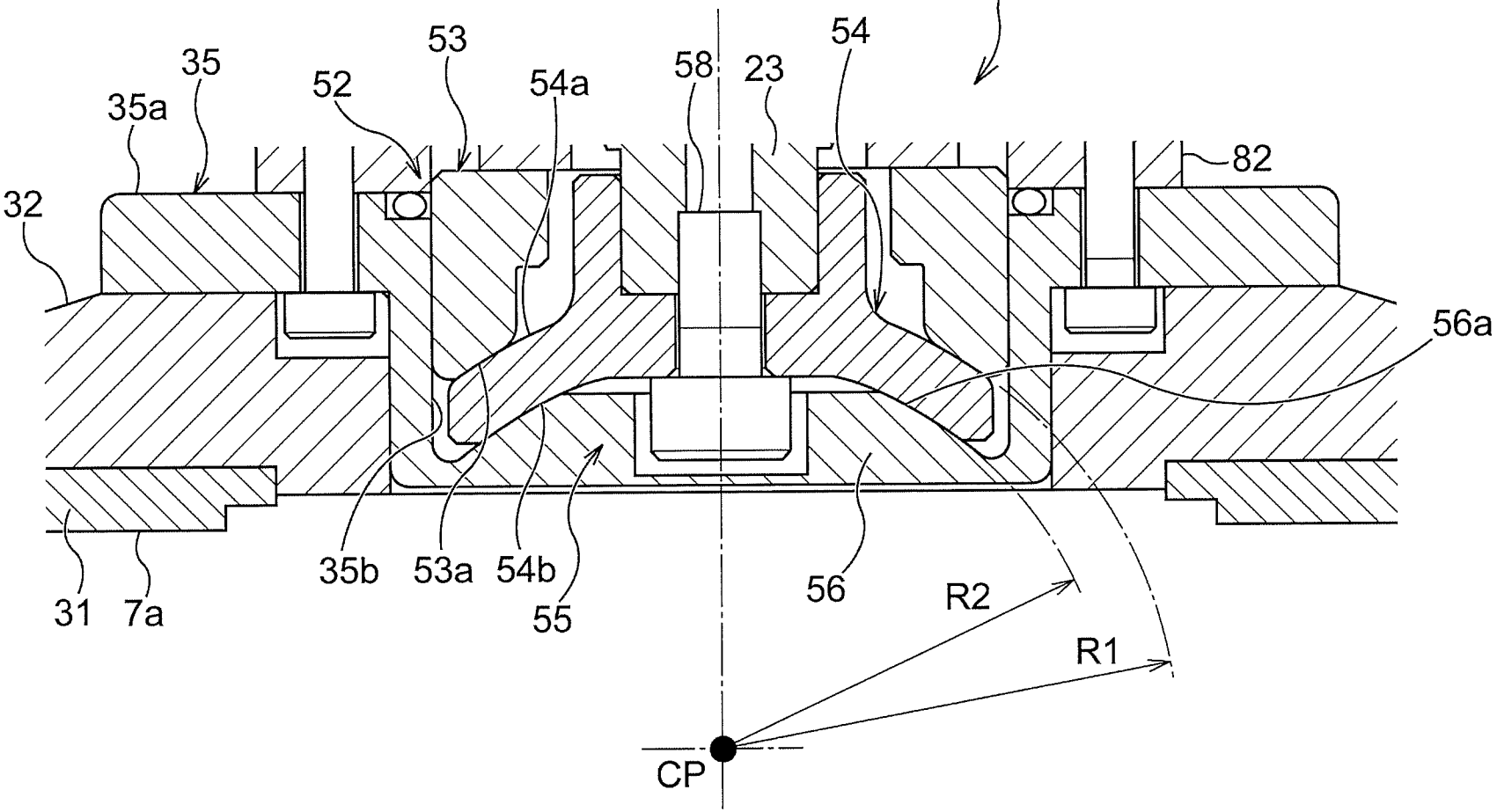
FIG. 14 is an enlarged view of the coupling mechanism shown in FIG. 13.

FIG. 13 is a schematic view showing a manner where the dresser 7 is coupled to the dresser shaft 23 through the coupling mechanism 50 in which the lower-bearing radius R2 is set to 24 mm, and the upper-bearing radius R1 is set to 28 mm. FIG. 14 is an enlarged view of the coupling mechanism 50 shown in FIG. 13.

When comparing the coupling mechanism 50 shown in FIG. 14 to the coupling mechanism 50 shown in FIG. 3, each shape of the first sliding-contact member 53, the second sliding-contact member 54, and the third sliding-contact member 56 of the coupling mechanism 50 shown in FIG. 14 is different from each shape of the first sliding-contact member 53, the second sliding-contact member 54, and the third sliding-contact member 56 in the coupling mechanism 50 shown in FIG. 3. Further, it can be seen that the rotational center CP of the coupling mechanism 50 shown in FIG. 14 is located lower than the rotational center CP of the coupling mechanism 50 shown in FIG. 3. In this manner, each shape of the first sliding-contact member 53, the second sliding-contact member 54, and the third sliding-contact member 56 is appropriately designed to thereby provide the coupling mechanism 50 having the lower-bearing radius R2 and the upper-bearing radius R1 that are determined by the above-described simulations.

The above-described embodiments are directed to the coupling mechanism 50 for coupling the dresser 7 to the dresser shaft 23. The coupling mechanism according to any one of the above-described embodiments may be used for coupling the polishing head 5 to the head shaft 14. In this case also, the above-described method of determining the bearing radius can be used to determine the lower-bearing radius R2 and the upper-bearing radius R1.

Although the embodiments according to the present invention have been described above, it should be understood that the present invention is not limited to the above embodiments, and various changes and modifications may be made without departing from the technical concept of the appended claims.

What is claimed is:

1. A method for making a rotating body comprising a polishing head or a dresser for use in a chemical mechanical polishing (CMP) machine, the rotating body comprising a bearing including an upper spherical bearing and a lower spherical bearing, wherein the CMP machine comprises a coupling mechanism for tiltably coupling the rotating body to a drive shaft, the rotating body to be pressed against a polishing pad, including the upper spherical bearing having a first concave contact surface and a second convex contact surface which is in contact with the first concave contact surface, and the lower spherical bearing having a third concave contact surface and a fourth convex contact surface which is in contact with the third concave contact surface, the upper spherical bearing and the lower spherical bearing having a same rotational center, the method comprising:

determining a lower-restoring torque of a rotating-body friction torque generated in the rotating body based on a relationship between a rotating-body frictional force between the polishing pad and the rotating body and a set of lower bearing radii, and determining a lower-bearing friction torque generated in the rotating body based on a lower-bearing frictional force between the third concave contact surface and the fourth convex contact surface, the lower-bearing friction torque being calculated when a point of application where the rotating-body friction torque is applied to the lower spherical bearing is set at an outer end of the lower spherical bearing for the set of lower bearing radii, wherein the lower restoring torque takes negative numbers in a polar coordinate system with its origin located on the rotational center, when the rotating body attempts to tilt toward a moving direction of the polishing pad, making the rotating body with the bearing having a radius of the lower spherical bearing greater than 20 mm and less than 24.5 mm for a gimbal-axis height where the rotational center is below a bottom surface of the polishing head or dresser so that the lower-bearing friction torque is cancelled by the lower restoring torque whereby vibration occurring in the rotating body is diminished.

2. The method of making the rotating body according to claim 1, further comprises the bearing having an upper-bearing radius of the upper spherical bearing selected from a set of upper bearing radii so that an upper-restoring torque is equal to or less than 0, and the upper-restoring torque is the sum of the rotating-body friction torque and an upper-bearing friction torque generated in the rotating body due to a frictional force between the first concave contact surface and the second convex contact surface.

3. A substrate polishing apparatus, comprising:

a polishing table for supporting a polishing pad;

a rotatable drive shaft, a polishing head coupled to the drive shaft by a coupling mechanism, the polishing head configured to be rotated by the drive shaft about an axis of rotation and to press a substrate against the polishing pad, the coupling mechanism comprising:

an upper spherical bearing having a concave contact surface, a lower spherical bearing having a bearing radius measured from a rotational center, which aligns with the axis of rotation, and a contact member having an upper convex surface and a lower concave surface, the contact member being fixed to the drive shaft and disposed between the upper spherical bearing and the lower spherical bearing, wherein the upper convex surface slidable engages with the concave contact surface of the upper spherical bearing and the lower convex surface engages with the convex contact surface of the lower spherical bearing, wherein the lower bearing radius is greater than 20 mm and less than 24.5 mm so that a lower restoring torque, based on a sum of a frictional force between the polishing head and the polishing pad when the polishing head is rotated against the polishing pad offset by a frictional force between the contact member, is equal to zero or causes the polishing head to tilt toward a moving direction of the polishing pad and the lower bearing for a gimbal-axis height where the rotational center is below a bottom surface of the polishing head.

4. The substrate polishing apparatus according to claim 3, wherein an upper-bearing radius of the upper spherical bearing, which is a distance from the rotational center to the concave contact surface, and the upper convex contact surface, is determined so that an upper-restoring torque is equal to or less than 0, and the upper-restoring torque is the sum of the rotating-body frictional force between the polishing head and the polishing pad when the polishing head is rotated against the polishing pad and an upper-bearing friction torque generated in the polishing head resulting from a frictional force between the concave contact surface and the upper convex contact surface, the upper-bearing friction torque being calculated when a point of application where the rotating-body friction torque is applied to the upper spherical bearing is set at an outer end of the upper spherical bearing, and the upper restoring torque takes negative numbers in a polar coordinate system, when the polishing head attempts to tilt toward a moving direction of the polishing pad.

5. A substrate polishing apparatus comprising:

a polishing table for supporting a polishing pad;

a polishing head configured to press a substrate against the polishing pad;

a rotatable drive shaft, and a dresser which is pressed against the polishing pad, wherein the dresser is coupled to the drive shaft by a coupling mechanism, the dresser configured to be rotated by the drive shaft about an axis of rotation, the coupling mechanism comprising an upper spherical bearing having a concave contact surface, a lower spherical bearing having a bearing radius measured from a rotational center, which aligns with the axis of rotation, and a contact member having an upper convex surface and a lower concave surface, the contact member being fixed to the drive shaft and disposed between the upper spherical bearing and the lower spherical bearing, wherein the upper convex surface slidable engages with the concave contact surface of the upper spherical bearing and the lower convex surface engages with the convex contact surface of the lower spherical bearing, wherein the lower bearing radius is greater than 20 mm and less than 24.5 mm, wherein a lower-restoring torque, based on a frictional force between the dresser and the polishing pad when the dresser is rotated against the polishing pad offset by a frictional force between the contact member and the lower bearing, is equal to zero or causes the dresser to tilt toward a moving direction of the polishing pad.

6. The substrate polishing apparatus according to claim 5, wherein an upper-bearing radius of the upper spherical bearing, which is a distance from the rotational center to the concave contact surface, and the upper convex contact surface, is determined so that an upper-restoring torque is equal to or less than 0, and the upper-restoring torque is the sum of the rotating-body frictional force between the polishing head and the polishing pad when the polishing head is rotated against the polishing pad and an upper-bearing friction torque generated in the polishing head resulting from a frictional force between the concave contact surface and the upper convex contact surface, the upper-bearing friction torque being calculated when a point of application where the rotating-body friction torque is applied to the upper spherical bearing is set at an outer end of the upper spherical bearing, and the upper restoring torque takes negative numbers in a polar coordinate system, when the polishing head attempts to tilt toward a moving direction of the polishing pad.

* * * * *